US006572215B2

(12) United States Patent
Sharma

(10) Patent No.: US 6,572,215 B2
(45) **Date of Patent: *Jun. 3, 2003**

(54) INK JET PRINT HEAD WITH CROSS-FLOW CLEANING

(75) Inventor: Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 43 days.

This patent is subject to a terminal disclaimer.

(21) Appl. No.: 09/867,639

(22) Filed: May 30, 2001

(65) Prior Publication Data

US 2002/0186270 A1 Dec. 12, 2002

(51) Int. Cl.[7] ..... B41J 2/165
(52) U.S. Cl. ..... 347/28
(58) Field of Search ..... 347/28, 27, 22

(56) References Cited

U.S. PATENT DOCUMENTS

| | | | | |
|---|---|---|---|---|
| 3,373,437 | A | 3/1968 | Sweet et al. | 347/74 |
| 3,416,153 | A | 12/1968 | Hertz et al. | 347/73 |
| 3,705,043 | A | 12/1972 | Zabiak | 106/22 |
| 3,776,642 | A | 12/1973 | Anson et al. | 356/418 |
| 3,846,141 | A | 11/1974 | Ostergren et al. | 106/22 |
| 3,870,528 | A | 3/1975 | Edds et al. | 106/22 |
| 3,878,519 | A | 4/1975 | Eaton | 347/75 |
| 3,889,269 | A | 6/1975 | Meyer et al. | 106/22 |
| 3,903,034 | A | 9/1975 | Zabiak et al. | 106/22 |
| 4,346,387 | A | 8/1982 | Hertz | 347/75 |
| 4,591,870 | A | 5/1986 | Braun et al. | 347/25 |
| 4,600,928 | A | 7/1986 | Braun et al. | 347/27 |
| 4,849,769 | A | 7/1989 | Dressler | 347/27 |
| 4,951,066 | A | 8/1990 | Terasawa et al. | 347/33 |
| 4,959,673 | A | 9/1990 | Noda | 347/33 |
| 4,970,535 | A | 11/1990 | Oswald et al. | 347/25 |
| 5,115,250 | A | 5/1992 | Harmon et al. | 347/33 |
| 5,148,746 | A | 9/1992 | Fuller et al. | 101/142 |
| 5,151,715 | A | 9/1992 | Ward et al. | 347/33 |
| 5,202,702 | A | 4/1993 | Terasawa et al. | 347/32 |
| 5,287,126 | A | 2/1994 | Quate | 347/25 |
| 5,305,015 | A | 4/1994 | Schantz et al. | 347/47 |
| 5,350,616 | A | 9/1994 | Pan et al. | 428/131 |
| 5,396,271 | A | 3/1995 | Premnath | 347/33 |
| 5,412,411 | A | 5/1995 | Anderson | 347/28 |
| 5,426,458 | A | 6/1995 | Wenzel et al. | 347/45 |
| 5,431,722 | A | 7/1995 | Yamashita et al. | 106/31.43 |
| 5,489,927 | A | 2/1996 | Harmon | 347/33 |
| 5,500,660 | A | 3/1996 | Childers et al. | 347/33 |
| 5,539,435 | A | 7/1996 | Uchida et al. | 347/33 |
| 5,555,461 | A | 9/1996 | Ackerman | 347/33 |
| 5,570,117 | A | 10/1996 | Karambelas et al. | 347/33 |
| 5,574,485 | A | 11/1996 | Anderson et al. | 347/27 |
| 5,583,548 | A | 12/1996 | Kearns | 347/33 |
| 5,612,722 | A | 3/1997 | Francis et al. | 347/33 |
| 5,614,930 | A | 3/1997 | Osborne et al. | 347/33 |
| 5,706,038 | A | 1/1998 | Jackson et al. | 347/33 |
| 5,717,445 | A | 2/1998 | Kida et al. | 347/33 |
| 5,725,647 | A | 3/1998 | Carlson et al. | 106/31.86 |
| 5,738,716 | A | 4/1998 | Santilli et al. | 106/31.77 |
| 5,745,133 | A | 4/1998 | Hendricks et al. | 347/33 |
| 5,774,140 | A | 6/1998 | English | 347/33 |
| 5,815,176 | A | 9/1998 | Rotering | 347/33 |
| 5,914,734 | A | 6/1999 | Rotering et al. | 347/28 |
| 5,949,448 | A | 9/1999 | Man et al. | 347/33 |
| 5,997,127 | A | 12/1999 | Fassler et al. | 347/28 |
| 6,017,110 | A | 1/2000 | Jackson | 347/33 |
| 6,082,848 | A | 7/2000 | Taylor | 347/35 |
| 6,132,026 | A | 10/2000 | Taylor et al. | 347/32 |
| 6,142,601 | A | 11/2000 | Sharma et al. | 347/28 |
| 6,168,258 | B1 | 1/2001 | Lou et al. | 347/33 |
| 6,189,999 | B1 | 2/2001 | Pham et al. | 347/33 |

*Primary Examiner*—Shih-Wen Hsieh
(74) *Attorney, Agent, or Firm*—Roland R. Schindler, II

(57) ABSTRACT

A self-cleaning print head is provided. The self-cleaning print head comprises a print head body having an outer surface defining an ink jet orifice. A source of pressurized cleaning fluid is provided to generate a flow of cleaning fluid at the outer surface during cleaning. A fluid drain is provided to receive the flow of cleaning fluid. A movable flow guide defines a flow path from the source of pressurized cleaning fluid along the outer surface and ink jet orifice and to the fluid drain. During cleaning, a translation drive moves the flow guides along a path that diverges from the flow path.

50 Claims, 14 Drawing Sheets

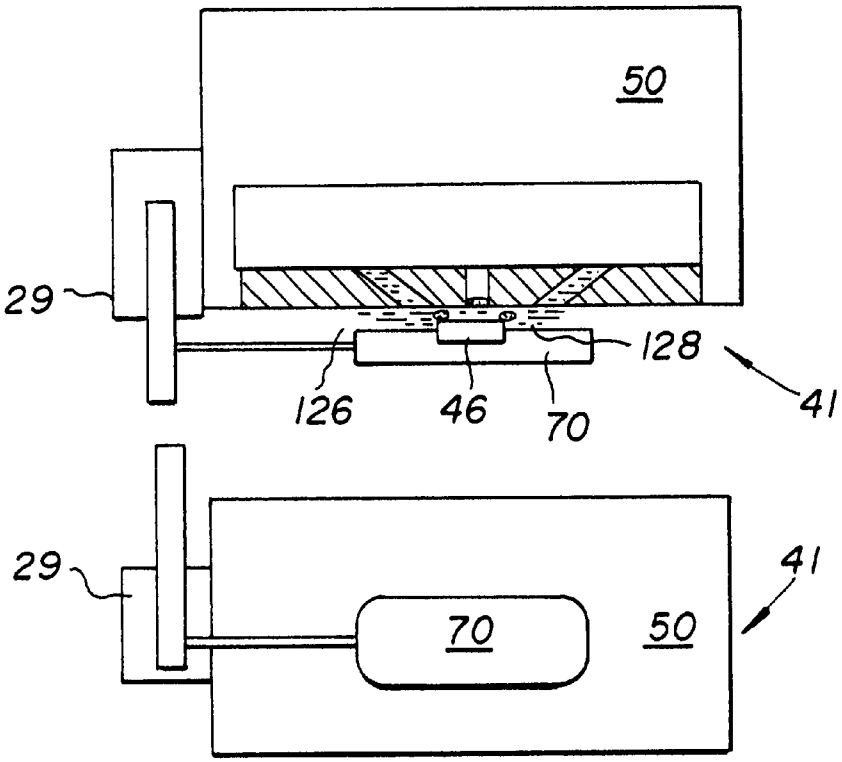
Fig. 9a
Fig. 9b
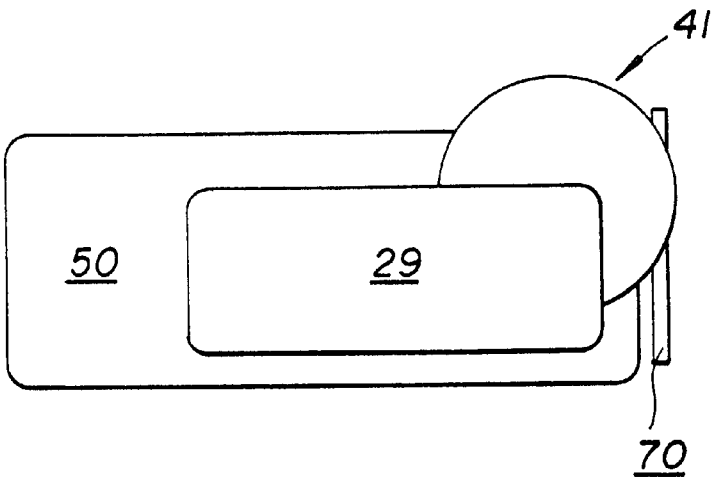
Fig. 9c

INK JET PRINT HEAD WITH CROSS-FLOW CLEANING

CROSS REFERENCE TO RELATED APPLICATIONS

Reference is made to commonly assigned co-pending U.S. patent application Ser. No. 09/751,620, filed Dec. 29, 2000, entitled SELF-CLEANING PRINTER AND PRINT HEAD AND METHOD FOR MANUFACTURING SAME, by Sharma et al.; Ser. No. 09/407,451, filed Sep. 28, 1999, entitled A SELF-CLEANING INK JET PRINTER SYSTEM WITH REVERSE FLUID FLOW AND METHOD OF ASSEMBLING THE PRINTER SYSTEM, by Sharma et al., Ser. No. 09/751,236, filed Dec. 29, 2000, entitled A SELF-CLEANING INK JET PRINTER AND PRINT HEAD WITH CLEANING FLUID FLOW SYSTEM, by Sharma et al., Ser. No. 09/750,993, filed Dec. 29, 2000, entitled INK JET PRINT HEAD WITH CAPILLARY FLOW CLEANING, by Sharma et al., and Ser. No. 09/195,727, filed Nov. 18, 1998, entitled AN INK JET PRINTER WITH CLEANING MECHANISM AND METHOD OF ASSEMBLING SAME.

FIELD OF THE INVENTION

This invention relates to a print head for use in printers having self-cleaning features and a printer having self-cleaning features.

BACKGROUND OF THE INVENTION

Ink jet printers produce images on a receiver by ejecting ink droplets onto the receiver in an imagewise fashion. The advantages of non-impact, low-noise, low energy use, and low cost operation in addition to the capability of the printer to print on a receiver medium such as plain paper are largely responsible for the wide acceptance of ink jet printers in the marketplace.

Many types of ink jet printers have been developed. One form of ink jet printer is the "continuous" ink jet printer. Continuous ink jet printers generate a stream of ink droplets during printing. Certain droplets are permitted to strike a receiver medium while other droplets are diverted. In this way, the continuous ink jet printer can controllably define a flow of ink droplets onto the receiver medium to form an image. One type of continuous ink jet printer uses electrostatic charging tunnels that are placed close to the stream of ink droplets. Selected droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the receiver.

Another type of ink jet printer is the "on demand" ink jet printer. "On demand" ink jet printers eject ink droplets only when needed to form the image. In one form of "on demand" ink jet printer, a plurality of ink jet nozzles is provided and a pressurization actuator is provided for every nozzle. The pressurization actuators are used to produce the ink jet droplets. In this regard, either one of two types of actuators are commonly used: heat actuators and piezoelectric actuators. With respect to heat actuators, a heater is disposed in the ink jet nozzle and heats the ink. This causes a quantity of the ink to phase change into a gaseous bubble and raise the internal ink pressure sufficiently for an ink droplet to be expelled onto the recording medium.

With respect to piezoelectric actuators, a piezoelectric material is provided for every nozzle. The piezoelectric material possesses piezoelectric properties such that an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate. When these materials are used in an ink jet print head, they apply mechanical stress upon the ink in the print head to cause an ink droplet to be ejected from the print head.

Inks for high speed ink jet printers, whether of the "continuous" or "on demand" type, must have a number of special characteristics. For example, the inks should incorporate a nondrying characteristic, so that drying of ink in the ink ejection chamber is hindered or slowed to such a state that by occasional "spitting" of ink droplets, the cavities and corresponding orifices are kept open.

Moreover, the ink jet print head is exposed to the environment where the ink jet printing occurs. Thus, the previously mentioned orifices and print head surface are exposed to many kinds of airborne particulates. Particulate debris may accumulate on the print head surface surrounding the orifices and may accumulate in the orifices and chambers themselves. Also, ink may combine with such particulate debris to form an interference burr that block the orifice or that alters surface wetting to inhibit proper formation of the ink droplet. Of course, the particulate debris should be cleaned from the surface and orifice to restore proper droplet formation.

Ink jet print head cleaners are known. One form of ink jet print head cleaner is disclosed in U.S. Pat. No. 4,970,535 titled "Ink Jet Print Head Face Cleaner" issued Nov. 13, 1990 in the name of James C. Oswald. This patent discloses an ink jet print head face cleaner that provides a controlled air passageway through an enclosure formed against the print head face. Air is directed through an inlet into a cavity in the enclosure. The air that enters the cavity is directed past ink jet apertures on the head face and out an outlet. A vacuum source is attached to the outlet to create a subatmospheric pressure in the cavity. A collection chamber and removable drawer are positioned below the outlet to facilitate disposal of removed ink. However, heated air is not a particularly effective medium for removing dried particles from the print head surface. Also, the use of heated air may damage fragile electronic circuitry that may be present on the print head surface.

Cleaning systems that use a cleaning fluid such as an alcohol or other solvent have been found to be particularly effective in removing contaminant from the surface of a print head. This is because the cleaning fluid helps to dissolve the ink and other contaminants that have dried to the surface of the print head. One ink jet print head cleaner that uses a solvent to clean portions of the print head is disclosed in commonly assigned U.S. Pat. No. 4,600,928 by Braun et al. This patent is directed to cleaning components within an ink jet print head of a continuous type. In Braun et al., an orifice plate is used to form ink droplets. These ink droplets are charged and are passed by a catcher that is selectively charged to attract droplets having a certain charge. The droplets that are permitted to pass the catcher are permitted to strike a media. During cleaning, a fluid meniscus of ink is statically supported along an axis that is generally normal to the orifice plate to form a meniscus between the charge plate, orifice plate and/or the catcher. This meniscus is ultrasonically excited to clean the orifice plate and charge plate and catcher. The ink from the meniscus is then ejected into a sump that is located at a cleaning station.

U.S. Pat. No. 5,574,485, to Anderson et al. also describes a cleaning station for cleaning a print head using an ultrasonically excited liquid meniscus. In Anderson, et al., the cleaning station comprises a cleaning fluid jet and a pair of vacuum orifices flanking the jet. During cleaning the jet is moved into a position that is proximate to the print head. The jet is separated from the print head by a distance, "t". In Anderson et al., "t" is defined as being "about 10 mil", 0.25 mm, or 250 microns. When the jet is so positioned, the jet defines a bulge of a cleaning fluid at the print head. A meniscus bridge of cleaning fluid is formed between the print head and the jet. Anderson et al., teaches that the print head is cleaned by scanning this meniscus bridge along the surface of the print head and by agitating the meniscus bridge using an ultrasonic vibrator. Cleaning fluid and any contaminants that are removed from the surface are entrained in the meniscus or left on the surface of the print head to be vacuumed from the surface by the vacuum orifices.

Thus, Braun et al. teaches that a print head can be cleaned in a non-contact manner using a static fluid meniscus and Anderson et al., teaches cleaning a print head using an ultrasonically excited meniscus that is scanned along the surface of a print head.

It will be recognized that it is often useful to apply mechanical force to clean contaminant that has dried to the surface of a print head or that is positioned within an ink jet orifice. In the prior art, a method known as wet wiping has been used to accomplish this end. In wet wiping, cleaning fluid is applied to the print head and a wiper is used to clean the cleaning fluid and contaminants from the print head. Examples of various wet wiping embodiments are shown in Rotering et al. U.S. Pat. No. 5,914,734. Each of these embodiments uses a cleaning station to apply cleaning fluid to the print head and mechanically wipes a wiper against the surface of the print head to clear contaminant from the print head surface. However, when wipers are used in this fashion, they can cause damage to fragile electronic circuitry and Micro Electro-Mechanical Systems (MEMS) that may be present on the surface of the print head. Further, the wiper itself may leave contaminants on the surface of the print head that can obstruct the orifices.

Thus, what is needed is a self-cleaning print head and a self-cleaning printer that have the cleaning benefits of both mechanical and fluidic cleaning while protecting the outer surface of the print head from damage during cleaning operations. What is also needed is a self-cleaning print head and a self-cleaning printer that cleans contaminant from the outer surface of the print head by applying mechanical force against the contaminant along more than one axis.

SUMMARY OF THE INVENTION

It is an object of the present invention to provide a self-cleaning print head that has the cleaning benefits of both mechanical and fluidic cleaning while still protecting the surface of the print head from damage during cleaning operations. It is another object of the present invention to provide a self-cleaning print head that cleans contaminant from the outer surface of the print head by applying mechanical force against the contaminant along more than one axis. These and other objects of the invention are accomplished by a self-cleaning print head. The self-cleaning print head comprises a print head body having an outer surface defining an ink jet orifice. A source of pressurized cleaning fluid is provided to generate a flow of cleaning fluid at the outer surface during cleaning. A fluid drain is provided to receive the flow of cleaning fluid. A movable flow guide defines a flow path from the source of pressurized cleaning fluid along the outer surface and ink jet orifice and to the fluid drain. During cleaning a translation drive moves the flow guide along a path that diverges from the flow path.

It is a further object of the present invention to provide a self-cleaning printer that has the cleaning benefits of both mechanical and fluidic cleaning while protecting the outer surface of the print head during cleaning operations. What is also needed is a self-cleaning printer that cleans contaminants from the outer surface of the print head by applying mechanical force against the contaminant along more than one axis. The self-cleaning printer comprises a printer body, a print head having an outer surface defining an ink jet orifice, a source of pressurized cleaning fluid to generate a flow of cleaning fluid at the outer surface during cleaning, a fluid drain to receive the flow of cleaning fluid, a movable flow guide defining a flow path from the source of pressurized cleaning fluid along the outer surface and ink jet orifice and to the fluid drain a translation drive for moving the flow guide along a path that diverges from the flow path.

BRIEF DESCRIPTION OF THE DRAWINGS

While the specification concludes with claims particularly pointing out and distinctly claiming the subject matter of the present invention, it is believed that the invention will be better understood from the following detailed description when taken in conjunction with the accompanying drawings wherein:

FIG. 9*a* shows a top view of a self-cleaning print head of the present invention in a cleaning position.

FIG. 9*b* shows a front view of a self-cleaning print head of the present invention in a cleaning position.

FIG. 9*c* shows a side view of a self-cleaning print head of the present invention in a cleaning position.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
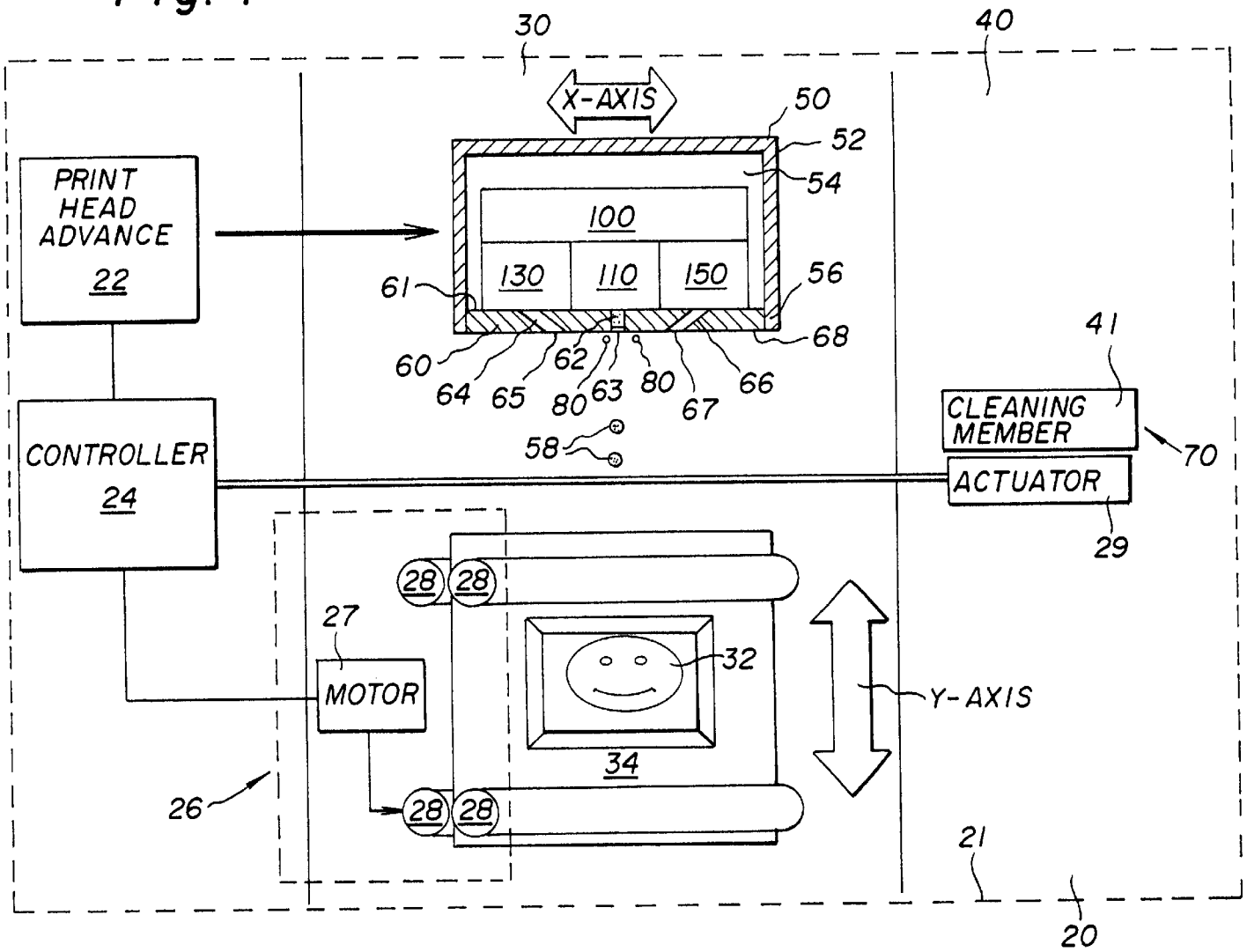
FIG. 1 shows an embodiment of the self-cleaning printer of the present invention wherein the printer is operated in a printing mode.

FIG. 1 shows a first embodiment of the self-cleaning printer of the present invention generally referred to as 20. Printer 20 prints images on a media 34, which may be a reflective-type receiver (e.g. paper) or a transmissive-type receiver (e.g. transparency). Printer 20 comprises a cabinet 21 containing a print head 50, a media advance 26 and a print head advance 22.

As is shown in FIG. 1, Y-axis displacement of media 34 relative to print head 50 is provided by media advance 26. The media advance 26 can comprise any number of well-known systems for moving media 34 within a printer 20, including a motor 27 driving pinch rollers 28, a motorized platen roller (not shown) or other well-known systems for paper and media movement. Print head advance 22 is fixed to print head 50 and translates print head 50 along an X-axis relative to media 34. Print head advance 22 can comprise any of a number of systems for moving print head 50 relative to a media 34 including among others a motorized belt arrangement (not shown) and a screw driven arrangement (not shown).

Controller 24 controls the operation of the print head advance 22 and media advance 26 and, thereby, can position the print head 50 at any X-Y coordinate relative to the media 34 for printing. For this purpose, controller 24 may be a model "CompuMotor" controller available from Parker Hannifin, Incorporated located in Rohmert Park, Calif. Controller 50 is preferably disposed within cabinet 21.

Print head 50 comprises print head body 52. Print head body 52 can comprise any of a box, housing, closed frame, or continuous surface or other rigid enclosure defining an interior chamber 54. A fluid flow system 100 is defined, at least in part, within interior chamber 54. The print head body 52 can be fixed to the media advance 27 for motion with the media advance 27. The media advance 26 can also define a holder (not shown) that moves with the media advance 26 and is shaped to receive and hold the print head body 52. It will be recognized that the print head body 52 can be defined in many shapes and sizes and that the shape and size of the print head body 52 will be defined by the space and functional requirements of the printer 20 into which the print head 50 is installed.

An orifice plate 60 is provided. Orifice plate 60 can be formed from a surface on the print head body 52. Alternatively, in the embodiment shown in FIGS. 1 and 2, print head body 52 defines an opening 56 into which orifice plate 60 is fixed. Orifice plate 60 can be made from a thin and flexible material such as nickel. Where such a flexible orifice plate 60 is used, structural member (not shown) is provided to support the orifice plate 60. Alternatively, orifice plate 60 can be made from a rigid material such as a silicon, a polymer or like material. The orifice plate 60 defines a fluid containment surface 61, and an outer surface 68. When orifice plate 60 is fixed in opening 56, outer surface 68 is directed toward media 34 while fluid containment surface 61 is directed toward interior chamber 54. Three passageways are defined between the fluid containment surface 61 and outer surface 68: an ink jet passageway 62 defining an ink jet orifice 63, a cleaning fluid passageway 64 defining a cleaning orifice 65 and a drain passageway 66 defining a drain orifice 67.

A fluid flow system 100 is schematically shown within interior chamber 54 of print head 50 in FIG. 1 and comprises a supply of pressurized ink 110, a supply of pressurized cleaning fluid 130, and a fluid return 150. Fluid connections are defined between supply 110 and ink jet passageway 62, between supply 130 and cleaning fluid passageway 64 and between the fluid return 150 and drain fluid passageway 66. During normal printing operations, fluid flow system 100 causes controlled amounts of ink to flow to the ink jet orifice 63 and form ink droplets 58. Images 32 are formed on the media 34 by depositing ink droplets 58 on media 32 in particular concentrations at particular X-Y coordinates.

It has been observed that during printing operations, outer surface 68 may become fouled by contaminant 80. Contaminant 80 may be, for example, an oily film or particulate matter residing on outer surface 68. The particulate matter may be particles of dirt, dust, metal and/or encrustations of dried ink, or the like. The oily film may be grease, or the like. In this regard, contaminant 80 may partially or completely obstruct ink jet orifice 63. The presence of contaminant 80 is undesirable because when contaminant 80 completely obstructs orifice 63 ink droplets 58 cannot exit orifice 63. Also, when contaminant 80 partially obstructs orifice 63, ink droplets 58 may be deposited at an incorrect or unintended X-Y coordinate on the media 32. In this manner, such complete or partial obstruction of orifice 63 leads to unwanted printing artifacts such as "banding", a highly undesirable result. The presence of contaminant 80 can also alter surface wetting and therefore inhibit proper formation of droplets 58 on surface 68 near orifice 63 thereby leading to such printing artifacts. Therefore, it is desirable to clean (i.e., remove) contaminant 80 to avoid printing artifacts.

Figure 2:
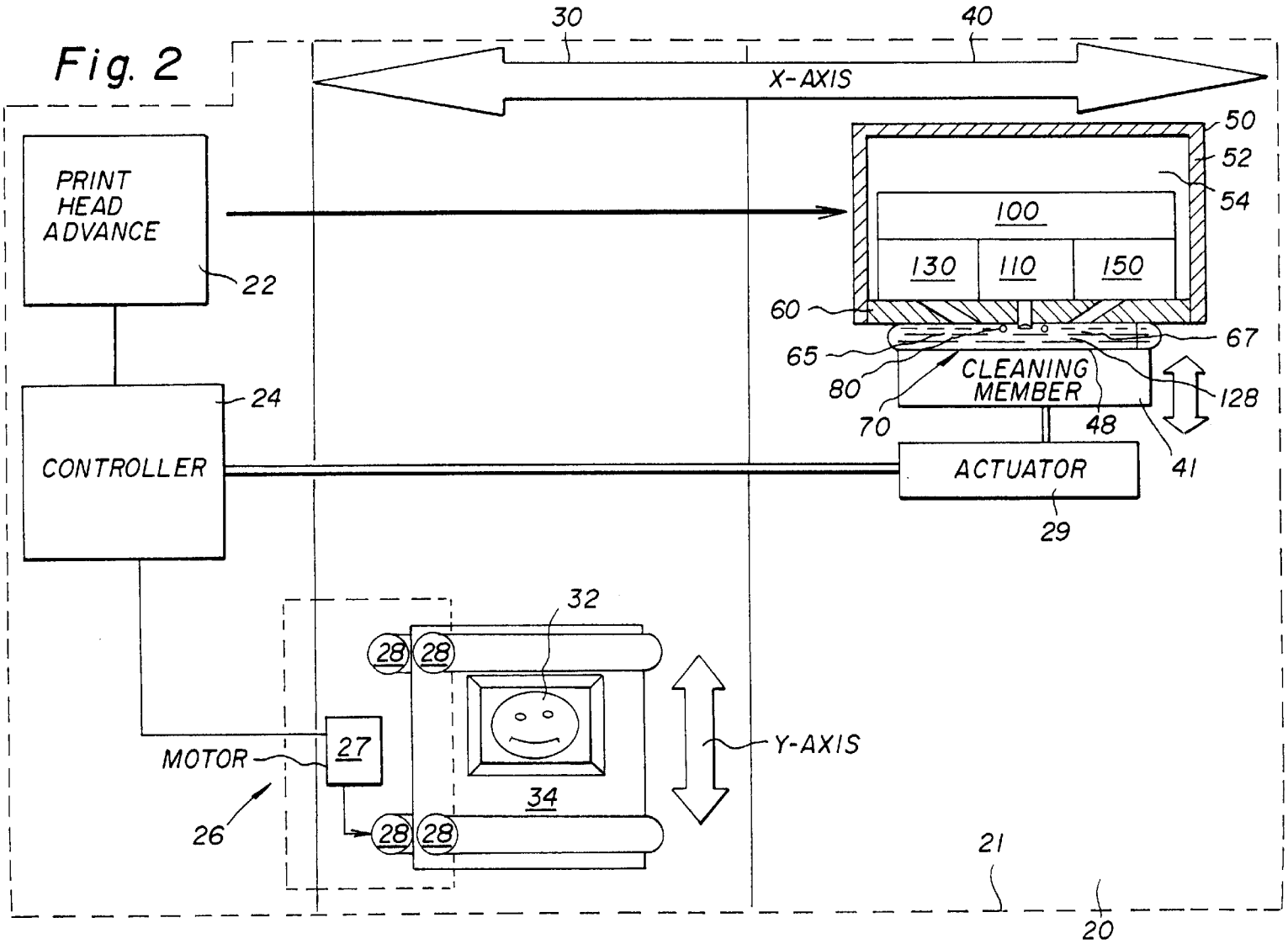
FIG. 2 shows the embodiment of FIG. 1, wherein the self-cleaning printer is operated in a self-cleaning mode.

FIG. 2 shows a diagram of the printer 20 operated to clean contaminant 80 from the surface 68 and ink jet orifice 63. When the controller 24 initiates a cleaning operation, the print head 50 is moved into a cleaning area 40 defined along the X-axis but separated from printing area 30. A cleaning member 41 and an actuator 29 are located within cleaning area 40. As is shown in FIG. 2, during cleaning, actuator 29 is used to position cleaning member 41 proximate to outer surface 68.

Cleaning member 41 comprises a flow guide 70. Flow guide 70 provides a fluid flow path from cleaning orifice 65 along outer surface 68 across ink jet orifice 63 and into drain orifice 67. During cleaning, a flow 128 of cleaning fluid 134 is discharged by supply 130 through cleaning orifice 65. The flow 128 of cleaning fluid 134 enters flow guide 70 and is guided along outer surface 68 and ink jet orifice 63. Flow 128 applies a mechanical force to help remove contaminant 80 from outer surface 68 and ink jet orifice 63. This mechanical force is largely directed along a single axis which is the axis along which cleaning fluid flows. However, there may be circumstances where contaminant 80 resists mechanical force applied along this axis. This can occur, because of the shape of contaminant 80, or the manner in which contaminant 80 is bound to outer surface 68. Accordingly, the present invention applies a mechanical force along an axis that diverges from the axis along which the cleaning fluid flows.

Figure 3A:
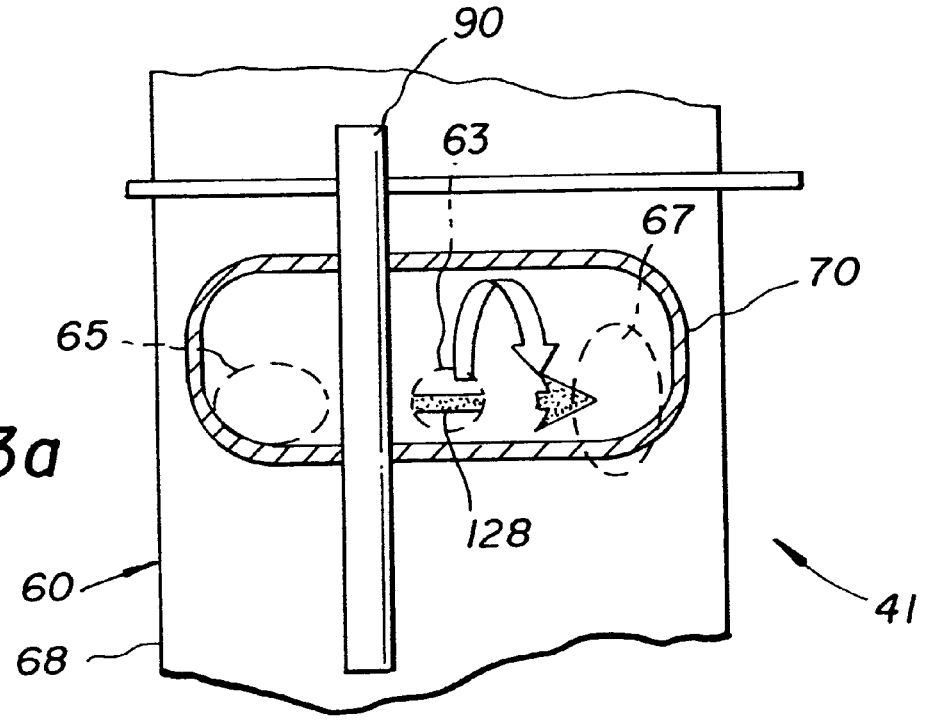
FIG. 3*a* shows a cross-section view of the self cleaning print head of the present invention with a capillary flow guide and with the translation drive positioning the flow guide and flow of cleaning fluid in a first cleaning position.
Figure 3B:
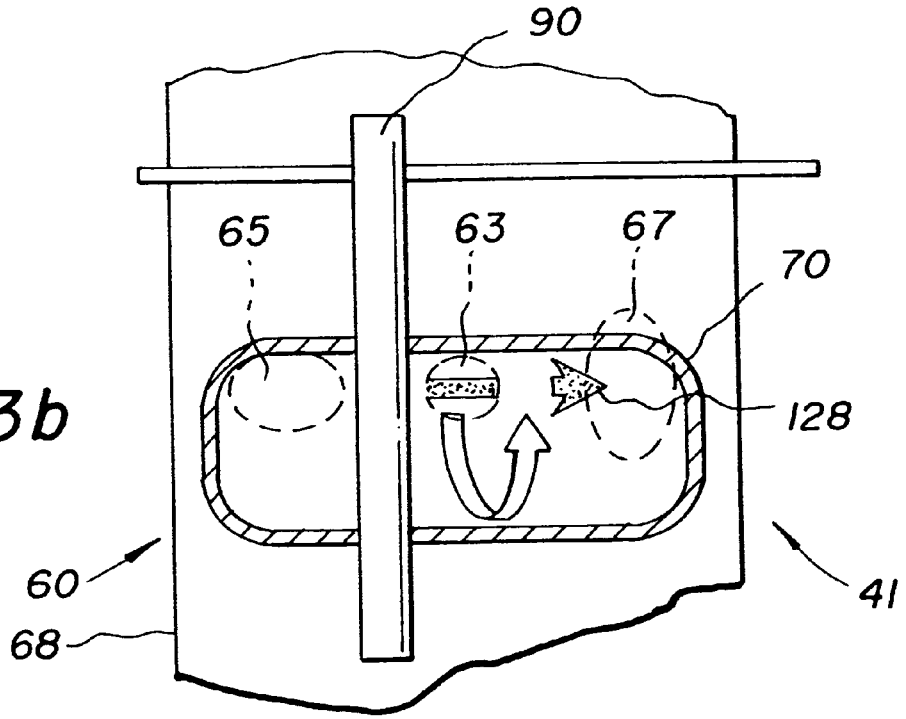
FIG. 3*b* shows a cross-section view of the self cleaning print head of the present invention with a capillary flow guide and with the translation drive positioning the flow guide and flow of cleaning fluid in a second cleaning position.

As is shown in FIGS. 3*a* and 3*b*, cleaning member 41 further comprises a translation drive 90. Translation drive 90 movably positions flow guide 70 along a direction that diverges from the direction of cleaning fluid flow. In a preferred embodiment shown in FIGS. 3*a* and 3*b*, this direction is perpendicular to the flow 128 of cleaning fluid 134. However, translation drive 90 can move the flow guide 70 along any direction that is not parallel to the flow 128 of cleaning fluid 134. As flow guide 70 is moved, the flow 128 of cleaning fluid 134 along outer surface 68 is disturbed. This disturbance causes cleaning fluid 128 to apply mechanical force against contaminant 80 at various angles. In this manner, mechanical force is against contaminant 80 from different directions thus enhancing cleaning efficiency and effectiveness. In a preferred embodiment of the present invention, translation drive 90 reciprocally moves flow guide 70 during cleaning.

Translation drive 90 can comprise linear actuators such as a hydraulic, pneumatic, thermal or electrostatic positioning device such as a pump or solenoid. Translation drive 90 can also be rotary driver such as an electric motor or hydraulic or pneumatic impeller. Where a rotary driver is used, the rotary motion of translation drive 90 can be applied to cause the desired movement of flow guides 70 directly or by the use of a cam, rack and pinion arrangement or pulley arrangement.

Translation drive 90 can also incorporate other mechanisms for movably positioning flow guide 70. For example, translation drive 90 can be formed using a material that changes dimensions to movably position flow guide 70. One example, of such a material is a metal that changes linear dimensions in response to the application of a voltage. Translation drive 90 can also be used to ultrasonically excite the flow guide 70 and to ultrasonically excite cleaning fluid 134. It will be appreciated that other mechanisms known to those of ordinary skill in the art can be used for this purpose.

Figure 4A:
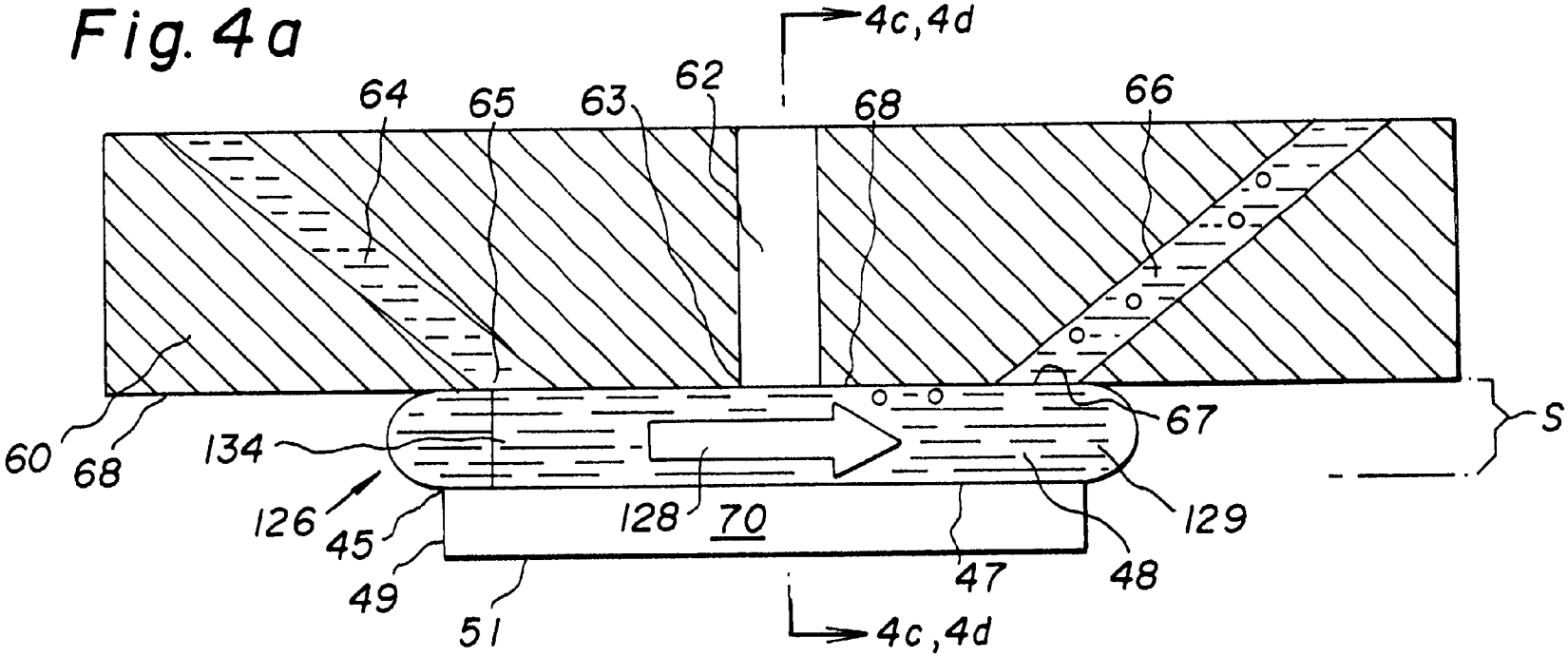
FIG. 4*a* shows a cross-section view of the orifice plate, flow path and capillary bridge flow guide of a print head of the present invention.
Figure 4B:
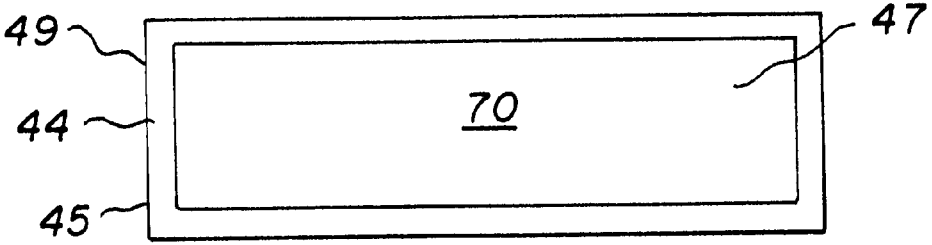
FIG. 4*b* shows a top view of a capillary flow guide of a print head of the present invention.

FIGS. 4*a*, 4*b*, 4*c* and 4*d* show a first embodiment of the present invention where a capillary flow guide 70 is used. FIG. 4*a* shows an enlarged cross section view of the orifice plate 60, flow path 48 and flow guide 70. FIG. 4*b* shows a view of a bottom surface of flow guide 70. As is shown in FIGS. 4*a* and 4*b* flow guide 70 comprises a bottom surface 51, a top surface 47 and side walls 49 joining bottom surface 51 to top surface 47. Top surface 47 and side walls 49 are joined at an edge 45. A perimeter 44 is defined on top surface 47 along edge 45. Typically, perimeter 44, is 1 to 10 microns wide. Although perimeter 44 is shown in FIG. 2 as co-planar with, top surface 47, perimeter 44 can be located either above or below bottom surface 47. Perimeter 44 is generally shaped to conform to the shape of outer surface 68 to permit a nearly constant spacing to be defined between top surface 47 and outer surface 68 in the region of perimeter 44.

Actuator 29 is used to position cleaning member 41 and flow guide 70 proximate to outer surface 68 so that top surface 47 confronts outer surface 68 in a region of outer surface 68 that includes at least a cleaning orifice 65 and a dram orifice 67. In a preferred embodiment, top surface 47 confronts outer surface 68 in a region that includes cleaning orifice 65, drain orifice 67 and ink jet orifice 63. Actuator 29, however, does not advance top surface 47 into contact with outer surface 68. Instead, actuator 29 positions perimeter 44 at a position where perimeter 44 is separated by a distance S from outer surface 68. In this regard, S is preferably established in the range of from 0.1 to 300 microns, to ensure that cleaning fluid 134 is confined to capillary fluid flow path 48, even when the pressure of the cleaning fluid 134 in cleaning fluid flow path 48 is above atmospheric pressure. The separation S can be reliably established in a number of ways. In one embodiment, a highly accurate mechanical positioning structure (not shown) cooperates with actuator 29 to guide outer surface 68 and perimeter 44 to create separation S. Such a structure can be created using manufacturing technologies such as Micro-Machining, as is well known in the art of Micro-Systems Technology (MST).

In an alternate embodiment, one or more sensors (not shown) cooperate with actuator 29 to position perimeter 44 at a distance S from the outer surface 68. In this embodiment, the sensor provides a signal that is indicative of the position of the perimeter 44 relative to outer surface 68 at one or more locations around perimeter 44 and actuator 29 is operated to move the perimeter 44 to a position that is removed from outer surface 68. In this regard, actuator 29 may be formed from microfabricated actuator structures that are well known in the MST art. Actuator 29 can also comprise a piezoelectric actuator.

In another embodiment of the present invention, the capacitance between perimeter 44 and outer surface 68 is sensed and used as a measure of the separation S. In this embodiment, the capacitance between perimeter 44 and outer surface 68 is sensed. Controller 24 determines proximity of perimeter 44 to outer surface 68 as a function of this capacitance. Controller 24 then operates actuator 29 to modify the position of cleaning member 41 to maintain the separation S between the perimeter 44 and the outer surface 68. In one embodiment, perimeter 44 is made from an electrically conductive material and the capacitance between the electrically conductive material of the perimeter 44 and the outer surface 68 is measured. In another embodiment, one or more capacitance sensors (not shown) are disposed on perimeter 44. These sensors can be defined using microfabricated sensor structures that are well known in the MST art. It will be understood that the separation S between perimeter 44 and outer surface 68 can also be measured using acoustic delay sensors or optical sensors. These sensors can also be microfabricated using known techniques.

It will be appreciated that other controllers that are well known in the art of control systems can be provided to cause actuator 29 to maintain the separation S in response to signals received from a sensor. Such controllers can work independently from controller 24. Such controllers can also work in co-operation with controller 24.

The space between top surface 47 and outer surface 68 defines a capillary fluid flow path 48. After the perimeter 44 of flow guide 70 is positioned at a desired distance S from outer surface 68, a pressurized flow 128 of cleaning fluid 134 is discharged from cleaning fluid orifice 65 and enters flow path 48. Cleaning fluid 134 may be any suitable liquid solvent composition, such as water, isopropanol, diethylene glycol, diethylene glycol monobutyl ether, octane, acids and bases, surfactant solutions and any combination thereof. Complex liquid compositions may also be used, such as micro emulsions, micellar surfactant solutions, vesicles and solid particles dispersed in the liquid. In certain embodiments of the present invention, ink can be used as a cleaning fluid. As the pressurized flow 128 of cleaning fluid 134 expands on outer surface 68 it approaches top surface 47 of flow guide 70. At this point capillary attraction causes cleaning fluid 134 to bridge between flow guide 70 and outer surface 68. As the flow continues, the volume of cleaning fluid bridge 129 expands between top surface 47 and outer surface 68 until it reaches edge 45 of flow guide 70.

A meniscus 126 of cleaning fluid 134 forms between outer surface 68 and flow guide 70 at edge 45. Meniscus 126 forms a fluidic seal that confines the flow 128 of cleaning fluid 134 within flow path 48. To contain a flow 128 of pressurized cleaning fluid 134 within flow path 48, meniscus 126 must be stable.

For greater stability of the meniscus 126, it is preferable that outer surface 68 be hydrophilic in the portion of outer surface 68 that is incorporated into the flow path 48. The stability of the meniscus 126 can further be increased where outer surface 68 is hydrophobic in regions that are outside of flow path 48.

Flow guide 70 can be formed from a variety of materials.

However, it is generally desired that the cleaning fluid be attracted to top surface 47 of flow guide 70 but be repelled by side walls 49 and top surface 51 of flow guide 70. Where, for example, an aqueous based cleaning fluid 134, is used, flow guide 70 can be defined using hydrophilic and hydrophobic surfaces that enhance the stability of meniscus 126. In this regard, top surface 47 of flow guide 70 shown in FIG. 3 is hydrophilic while the side walls 49 and bottom surface 51 of the cleaning member 41 are hydrophobic so that the cleaning fluid 134 does not tend to spread onto side walls 49 or bottom surface 51. It is also preferable that top surface 47 and side walls 49 of flow guide 70 are defined at right angles with a sharp corner having a radius of curvature on the order of 0.1 micrometers in order to "pin" the meniscus 126 in a stable position preventing it from moving away from perimeter 44, as is known in the art of capillary flow.

Once established, meniscus 126 is sufficiently stable to maintain the integrity of the seal even where a negative pressure with respect to atmospheric pressure is defined within flow path 48. This is possible because the meniscus 126, once pinned at the edge 45 of flow guide 70, requires a pressure difference in order to be withdrawn from edge 45. The magnitude of this pressure difference is defined by the pressure equation discussed above. Thus, meniscus 126 is stable and provides an effective seal for flow path 48 over a range of positive and negative fluid pressures. The degree to which this range can deviate from atmospheric pressure is defined, under the equation described above, as a function of the surface tension of the cleaning fluid 134 and S. Importantly, the pressure is inversely proportional to the magnitude of S thus, the pressure in the capillary fluid flow path 48 can be substantially increased over atmospheric pressure or decreased from atmospheric pressure where S is minimized.

Over the range of pressures, the shape of the fluidic seal changes but the line of contact between the meniscus 126 and perimeter 44 does not change. Thereby, the exact shape, size and pressure distributions of the capillary fluid flow path 48 are known and can be precisely controlled by controlling the pressures of the cleaning fluid 124 in the supply of pressurized cleaning fluid 130, and fluid return 150. This is particularly advantageous when only a single drain orifice 67 is present and is located inside the perimeter 44. In such an embodiment, the meniscus 126 will remain stable despite changes in the pressure distribution within the capillary fluid flow path 48 that are used to balance the rate of flow of cleaning fluid 134 entering capillary fluid flow path 48 and the rate of cleaning fluid 134 leaving capillary fluid flow path 48 via drain fluid flow path 156.

The meniscus 126 is also useful in allowing the print head to be positioned at a range of angles during cleaning. This range of angles includes angles up to 90 degrees relative to the angle of gravitational force acting on the print head. It will be understood that this is possible because the gravitational pressure drop across a one inch long print head that is oriented vertically is only about 1/400 of an atmosphere. In comparison, the pressure tolerance of a meniscus 126 for which S is, for example, 7 microns is 1/10 of an atmosphere for a typical cleaning fluid.

As described more generally above, the present invention uses mechanical force applied from divergent directions to physically remove contaminant 80 from outer surface 68 and ink jet orifice 63. In the present invention, one mechanical force applied on a first direction by a flow 128 of pressurized cleaning fluid 134 within the flow path 48. Flow 128 is created by a pressure gradient, between cleaning orifice 65 and drain orifice 67. In such a pressure gradient, the fluid pressure at cleaning orifice 65 is provided at a level that is greater than the fluid pressure at the drain orifice 67. It will be understood that the pressure gradient is relative and that a pressurized flow 128 of a cleaning fluid 134 can be created even where the fluid pressure of the cleaning fluid 134 at drain orifice 67 is positive. Accordingly it will also be understood that such a pressure gradient can be achieved without applying a vacuum to drain orifice 67.

It will be recognized that, using the flow path 48 of the present invention, it is possible to define, with great precision, the areas of outer surface 68 that will be cleaned. This is because the pressurized flow 128 of cleaning fluid 134 spreads out to fill the entire flow path 48 during cleaning. Thus, flow path 48 only exists in regions of orifice plate 68 that are within perimeter 44 of flow guide 70 Thus, the size, shape and course taken by the flow of cleaning fluid 136 through capillary fluid flow path 48 is defined by the geometric properties of the perimeter 44 of top surface 47. From this, it will be appreciated that it is possible to a capillary fluid flow path having a very complex pattern simply by modifying the shape of the perimeter 44 of top surface 47. In this regard, perimeter 44 of top surface 47 can be defined to provide a variety of structures to control the flow 128 of cleaning fluid 134 from a cleaning orifice 68 to a drain orifice 67.

The size, shape, and course taken by the flow path 48 can also be defined by other characteristics of top surface 47. For example, regions of top surface 47 and outer surface 68 within perimeter 44 can be defined that have hydrophilic properties and that have hydrophobic properties. These properties can also be used to define flow path 48. These features may be combined to form a flow guide 70 that provides very accurate control of the flow 128 of cleaning fluid 134 across outer surface 68. A number of specific example embodiments are described in commonly assigned and co-pending U.S. patent application Ser. No. 09/751,260.

Figure 4C:
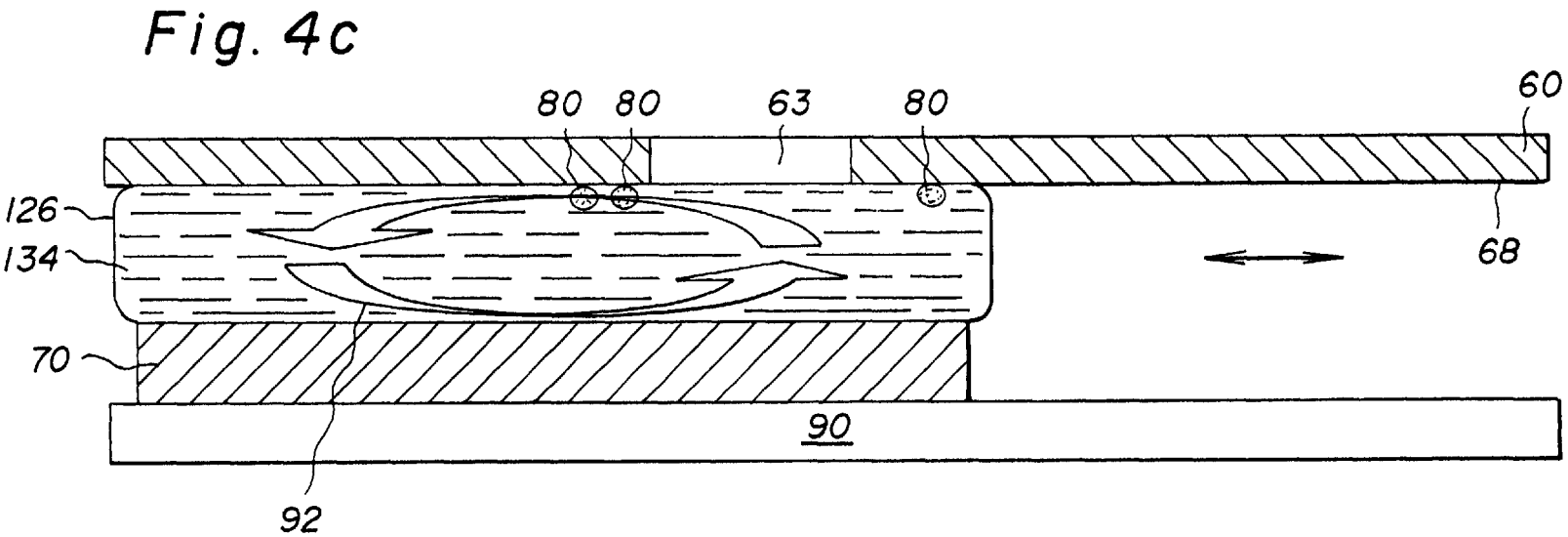
FIG. 4*c* shows a cross section view of the orifice plate, flow path, capillary flow guide and translation drive of the present invention with the flow path and capillary drive positioned in a first cleaning position.
Figure 4D:
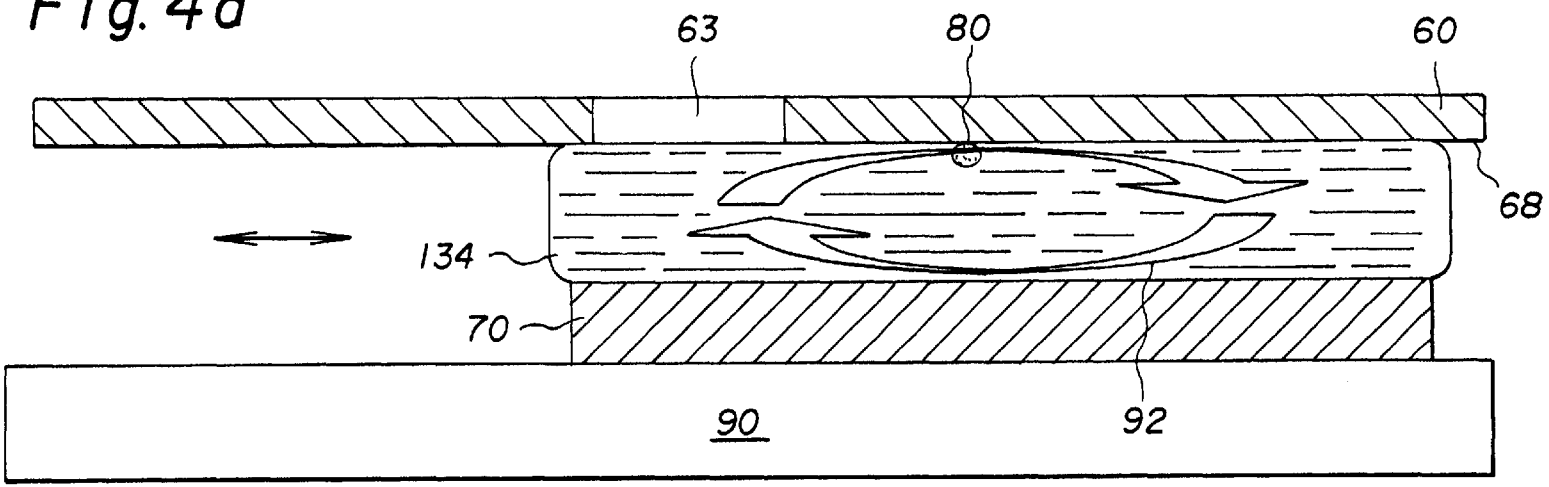
FIG. 4*d* shows a cross section view of the orifice plate, flow path, capillary flow guide and translation drive of the present invention with the flow path and capillary drive positioned in a second cleaning position.

Once the liquid meniscus has been created, translation drive 90 is activated. FIGS. 4*c* and 4*d* show a cross-section of cleaning member 41, translation drive 90, flow guide 70, flow path 48 and orifice plate 60 during cleaning operations. During cleaning, flow path 48 is established with flow guide 70 in a first position. However, while cleaning fluid flows through flow path 48, translation drive 90 is actuated and moves flow guide 70 along an axis that is perpendicular to the direction of the flow 128 of cleaning fluid 134. Thus, flow guide 70 is moved from the position shown in FIG. 4*a* to the position shown in FIG. 4*b*. This movement induces cross-currents and vortex flow 92 of cleaning fluid 128 as it passes through flow path 48. The cross-currents and vortex flow 92 applies mechanical force against contaminant 80 along second directions that diverge from the direction of flow 128 of cleaning fluid 134 and helps to dislodge contaminant 80 from outer surface 68 and orifice 63. Contaminant 80 that is dislodged from outer surface 68 and orifice 63 is then removed by the flow 134 of cleaning fluid 128 and travels into drain orifice 67.

Figure 5A:
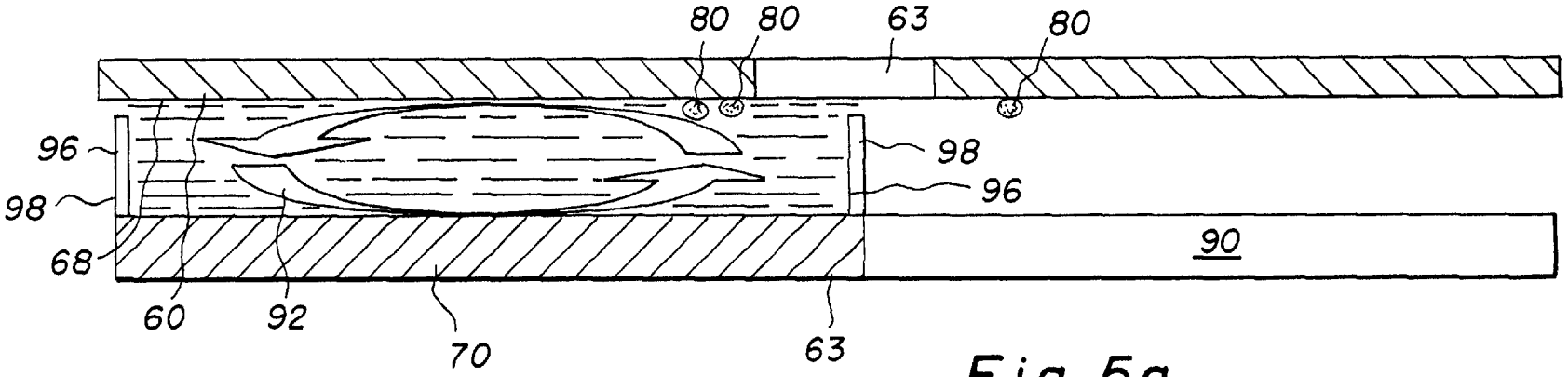
FIG. 5*a* shows a cross-section view of the self-cleaning print head of the present invention with a capillary flow guide and optional curtain in a first cleaning position.
Figure 5B:
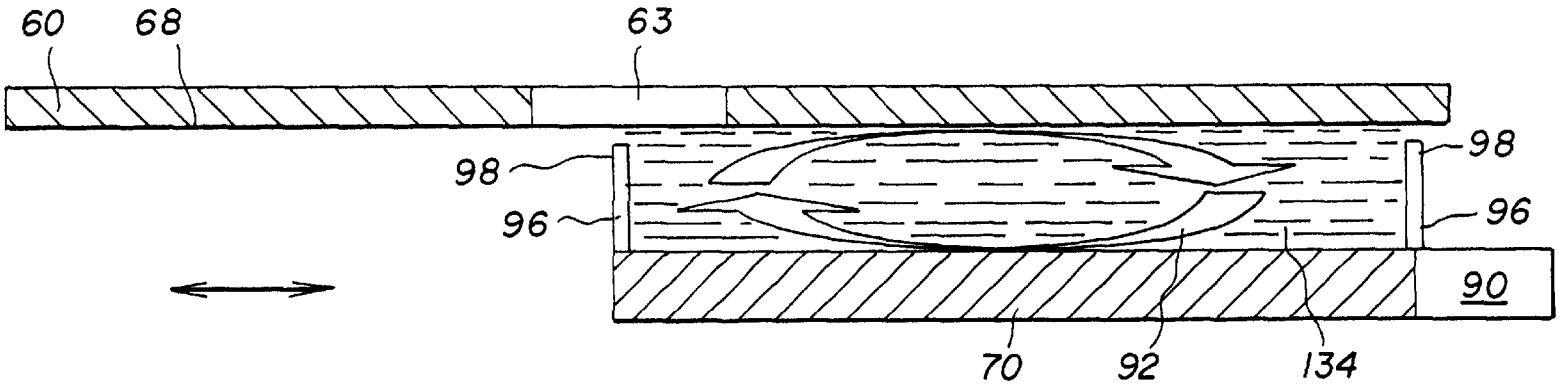
FIG. 5*b* shows a cross-section view of the self-cleaning print head of the present invention with a capillary flow guide and optional curtain positioned in a second cleaning position.

Another embodiment of the print head of the present invention is shown in FIGS. 5*a* and 5*b* which depict a cross-section view of orifice plate 60, capillary fluid flow path 48 and flow guide 70, curtain 96 depends from edge 45 and extends away from bottom surface 47. As is shown in FIG. 5*a*, flow guide 70 further comprises a curtain 96 of a hydrophobic thin film material. Curtain 96 shown in FIG. 5*a* is a polyamide of thickness 1 to 10 microns. However, curtain 96 can be formed from any of a polyisoprene, poly-urethane, poly(ester-urethane), polydimthylsoxane, polyamide, polyvinylchloride, natural rubber, polyethylene, polybutadiene, polyacrylonitrile, and polytetrafluorethylene. Curtain 96 can be formed from other polymer or metallic films.

In this embodiment, the pressure that can be contained within cleaning fluid flow path 48 is defined by the separation S between the perimeter 44 and outer surface 68. However, perimeter 44 and edge 45 are defined at the bottom edge 98 of curtain 96. A preferred range of separation between perimeter 44, which is defined at bottom edge 98, and outer surface 68, is in the range of 0.1 to 100 microns.

In this embodiment, translation drive 90 is made from a material that expands and contracts during cleaning. As is shown in FIG. 5*a*, translation drive 90 expanded and in its expanded state position flow guide 70 in a first position shown if FIG. 5*a* when translation drive 90 contracts during cleaning. Flow guide 70 moves from a first position shown in FIG. 5*a* to a second position shown in FIG. 5*b*. This movement induces cross currents and vortex flow 92 in the flow 128 of cleaning fluid 136 as described in greater detail above.

Figure 6A:
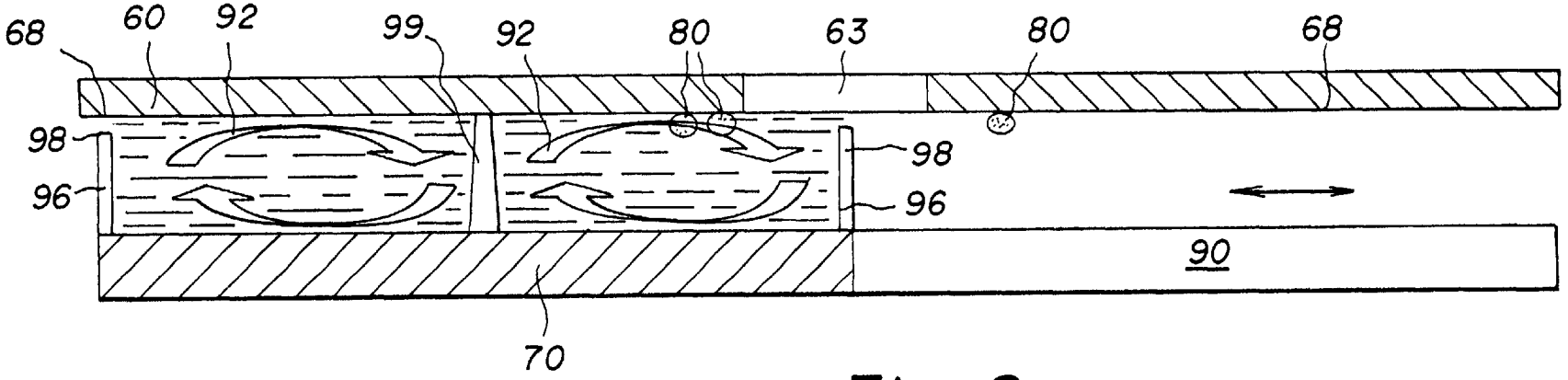
FIG. 6*a* shows another embodiment of the present invention wherein the cleaning member includes a wiper with the flow guide positioned in a first cleaning position.
Figure 6B:
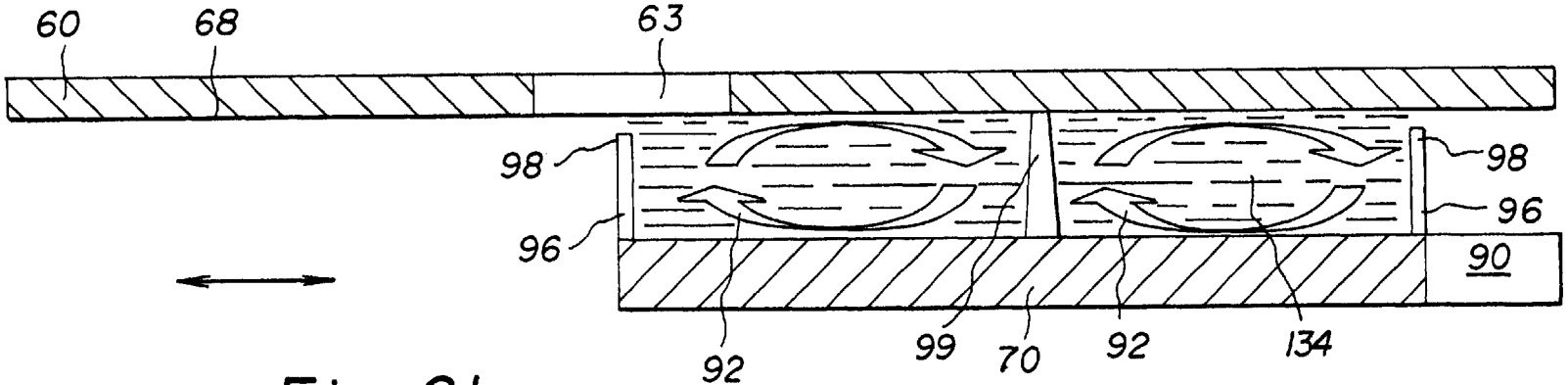
FIG. 6*b* shows another embodiment of the present invention wherein the cleaning member includes a wiper with the flow guide positioned in a second cleaning position.

FIGS. 6*a* and 6*b* show another embodiment of the present invention wherein cleaning member 48 includes a wiper 99 depending from flow guide 70. Wiper 99 contacts outer surface 68 during cleaning. Wiper 99 is moved in conjunction with flow guide 70 during cleaning and applies a mechanical force along the same path that translation drive 90 moves flow guide 70. Thus, in this embodiment, three forces are applied from various directions to remove contaminant 80 from outer surface 68, the flow 128 of cleaning fluid 134 from cleaning orifice 65 to drain orifice 67, the cross-currents and vortex flow 92 created by translation of flow guide 70 and mechanical action of wiper 99 against outer surface 68. In this embodiment, the pressurized flow of cleaning fluid lubricates and cools wiper 99 and outer surface 68 during wiping to prevent damage to the MEMS and further clears outer surface 68 of any contaminant 80 created by wiper 99. It will be understood that wiper 99 can be used with or without a flow guide 70 having curtain 96.

Figure 7A:
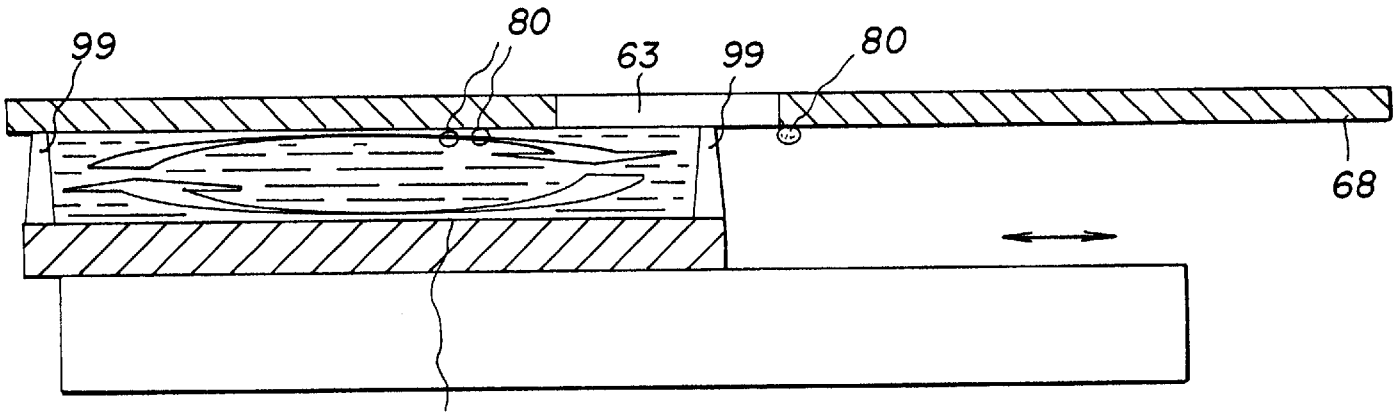
FIG. 7*a* shows another embodiment of the present invention wherein the flow guide comprises a surface and pair of wipers with the flow guide positioned in a first cleaning position.
Figure 7B:
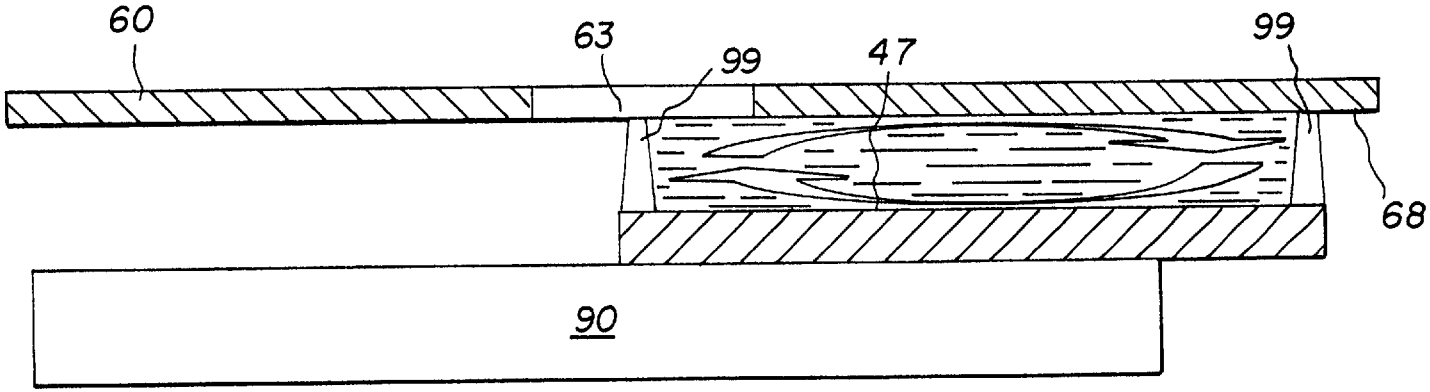
FIG. 7*b* shows another embodiment of the present invention wherein the flow guide comprises a surface and pair of wipers with the flow guide positioned in a second cleaning position.

FIGS. 7*a* and 7*b* show an embodiment of the present invention wherein flow guide 70 comprises a top surface 47 and a pair of wipers 99. In this embodiment, both of wipers 99 form a contact seal with outer surface 68 and flow 128 of cleaning fluid 134 travels from cleaning orifice (not shown) to the drain orifice not shown along a path defined by wipers 99, top surface 47 and outer surface 68. The movement of flow guide 70 by translation drive 90 induces cross-currents and vortex flow 92 and further causes wipers 99 apply a mechanical force along outer surface 68 to separate contaminant 80 from outer surface 68.

Figure 8A:
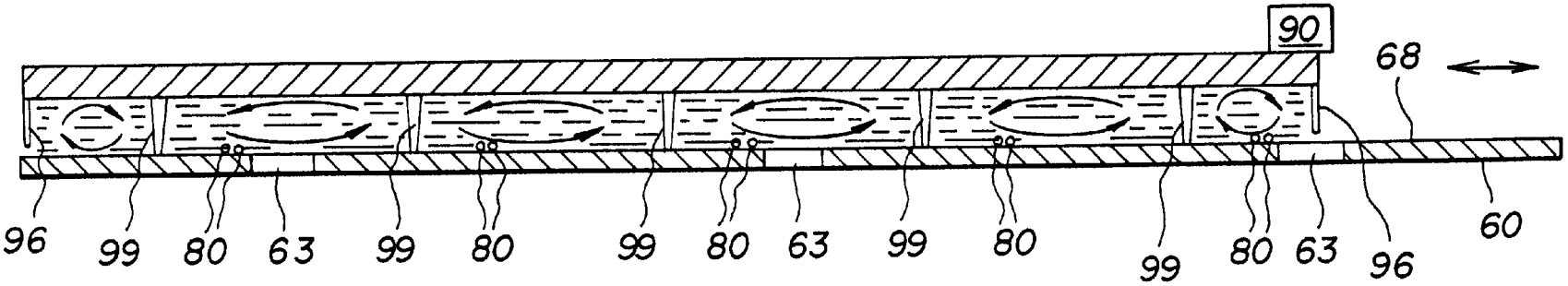
FIG. 8*a* shows an embodiment of the present invention for cleaning an outer surface having more than one nozzle with the flow guide positioned in a first cleaning position.
Figure 8B:
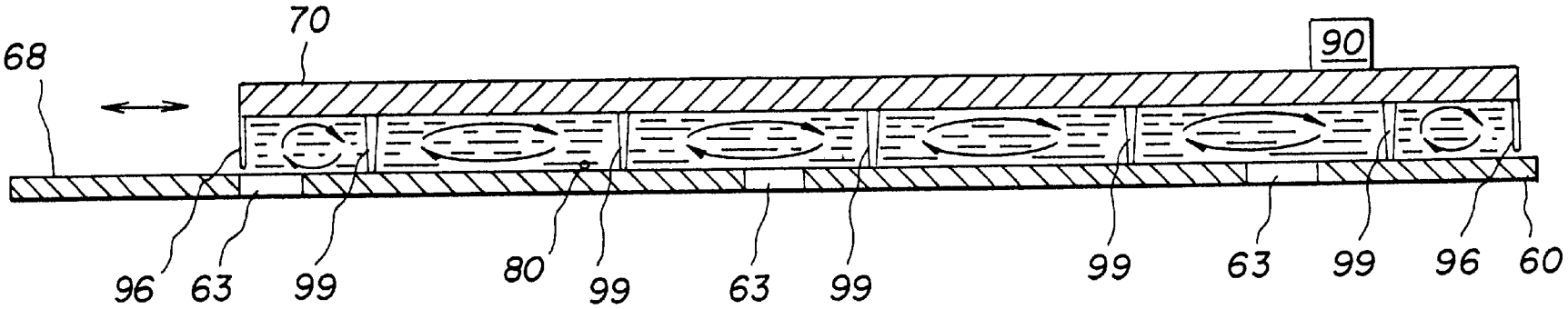
FIG. 8*b* shows an embodiment of the present invention for cleaning an outer surface having more than one nozzle with the flow guide positioned in a second cleaning position.

It will be appreciated that the present invention can be used to clean an outer surface 68 having more than one ink jet nozzle 63. One example embodiment of this type is shown in FIGS. 8*a* and 8*b*. As is seen FIG. 8*a*, flow guide 70 is sized so that it confronts multiple ink jet orifices 63. In this embodiment, flow guide 70 is shown having optional curtain 96 and wipers 99. Outer surface 68 is cleaned by the discharge of a flow 128, cleaning fluid 134 and by cross-currents and vortex flow 92. Further, surface 68 and ink jet orifices 63 are cleaned by action of wiper 99 as translation drive 90 moves flow guide 70 from the position of FIG. 8*a* to the position of FIG. 8*b*.

With respect to FIG. 9, what is shown is a top partial cross-section view (FIG. 9*a*), front view (FIG. 9*b*) and side view (FIG. 9*c*) of print head 50 of the present invention wherein cleaning member 41 comprises an actuator 29 and flow guide 70 fixed to print head body 54. As is shown in FIGS. 9*a*, 9*b*, and 9*c*, flow guide 70 is retracted during printing operations to a position where flow guide 70 does not interfere with the potential flow of ink droplets 58 from ink jet orifice 63.

Figure 10A:
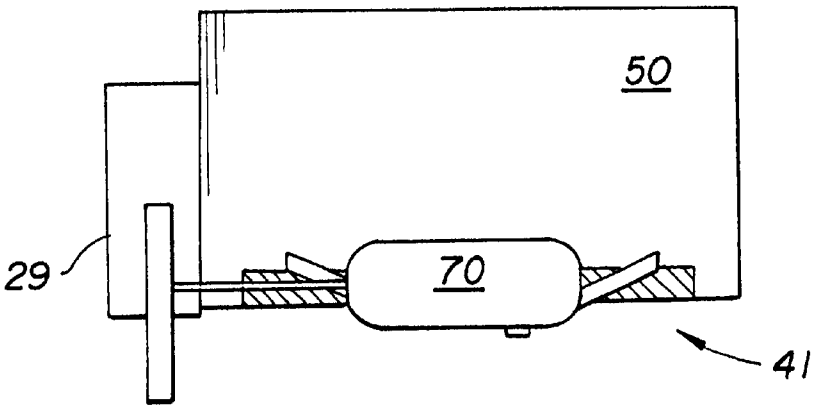
FIG. 10*a* shows a top view of a self-cleaning print head of the present invention in a printing position.
Figure 10C:
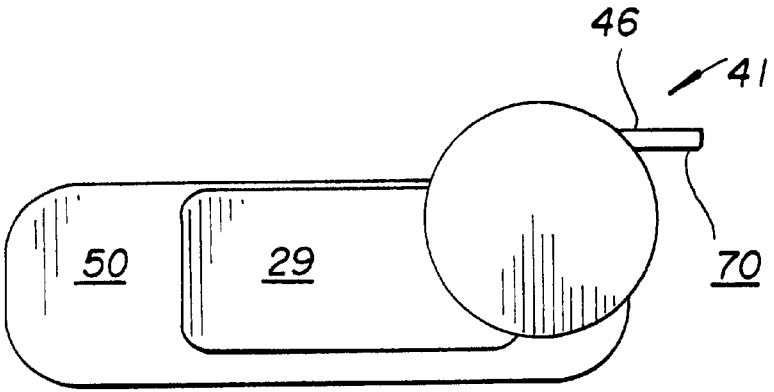
FIG. 10*c* shows a side view of a self-cleaning print head of the present invention in a printing position.
Figure 10B:
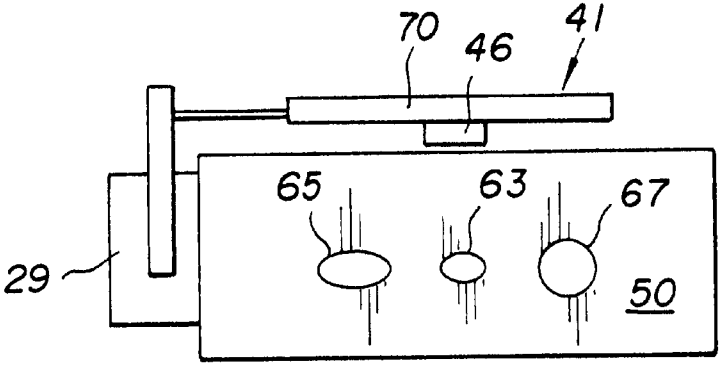
FIG. 10*b* shows a front view of a self-cleaning print head of the present invention in a printing position.

With respect to FIGS. 10*a*, 10*b*, and 10*c*, what is shown is, respectively, a top, front and side view of print head 50 of the present invention with flow guide 70 positioned by actuator 29 proximate to outer surface 68. This is the cleaning position. While flow guide 70 is in the cleaning position, a flow 128 of cleaning fluid 134 is defined from cleaning orifice 65. This cleaning fluid forms a liquid meniscus 126. This permits cleaning fluid to flow from cleaning orifice 65 across outer surface 68, across ink jet orifice 63 and into drain orifice 67. In this embodiment, actuator 29 can be used both for positioning the flow guide 70 proximate to outer surface 68 and for translating flow guide 70 in a direction that diverges from the direction of the flow 128 of cleaning fluid 134 across surface 68.

As is also shown in FIGS. 9*a*, 9*b*, and 9*c*, and FIGS. 10*a*, 10*b*, and 10*c*, an optional ultrasonic transducer 46 is provided. Ultrasonic transducer 46 is fixed to flow guide 70 and is used to ultrasonically excite the flow 128 of cleaning fluid 134 to further disrupt the flow 128 of cleaning fluid 134 across outer surface 68 and ink jet orifice 63.

It will be recognized that the cleaning fluid passageway 66, drain fluid passageway 68 and ink fluid passageway 64 have been shown passing through orifice plate 60 at various angles relative to the surfaces 61 and 68. It will be recognized that consistent with the principles of the present invention, passageways 62, 64, 66 can take an angular, curved, or straight path between surface 61 and surface 68 as may be dictated by machine, fabrication, rheology and/or cost considerations.

Figure 11A:
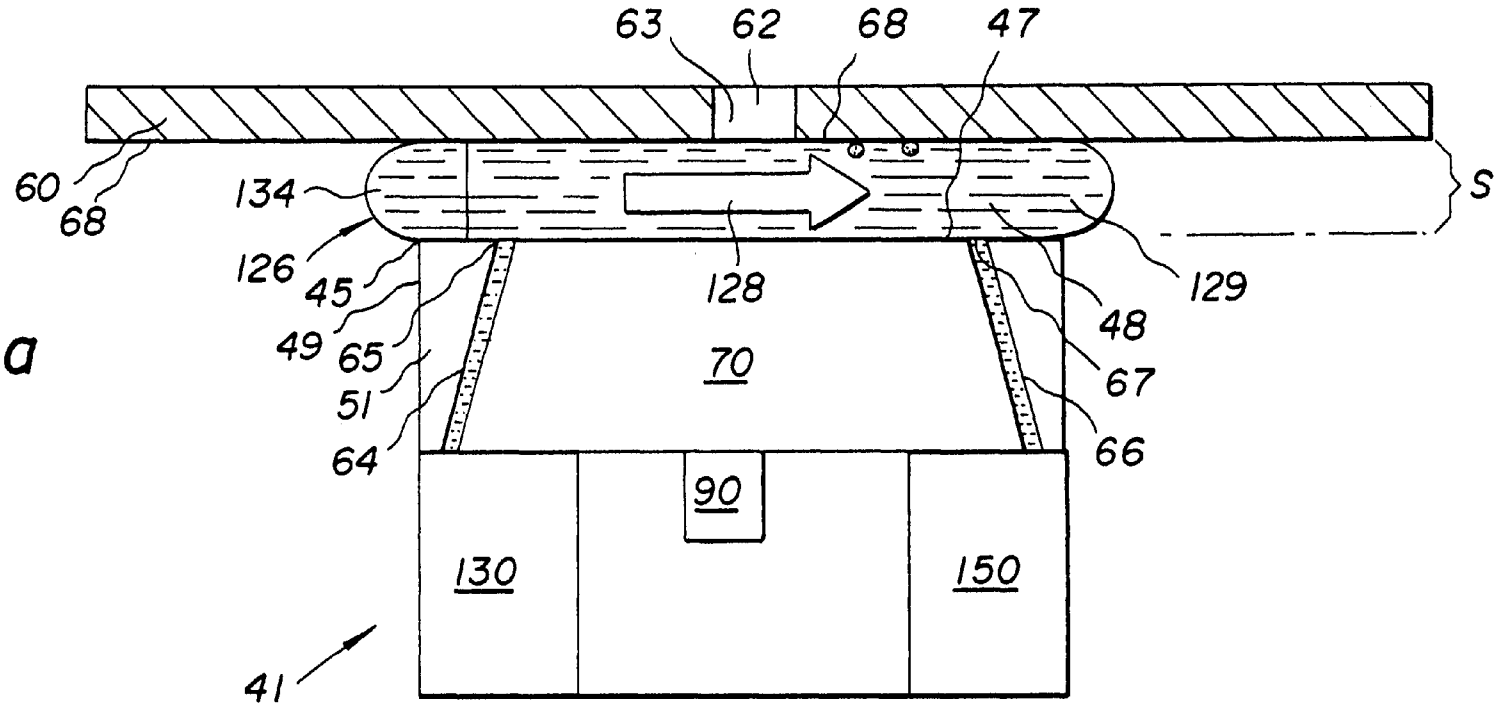
FIG. 11*a* shows an embodiment of the present invention where cleaning fluid is supplied and removed using flow guide 70.
Figure 11B:
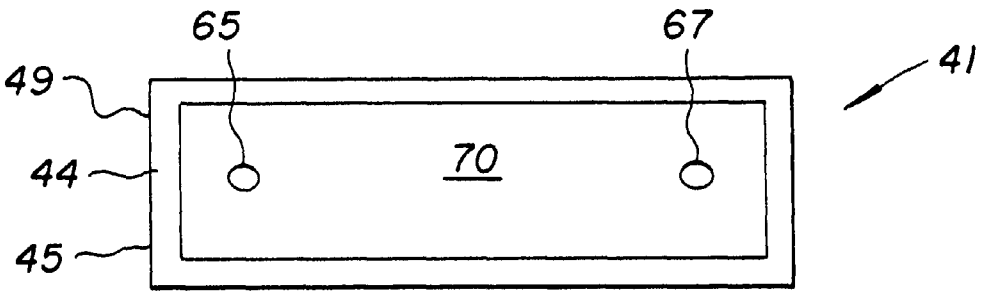
FIG. 11*b* shows an embodiment of the present invention where cleaning fluid is supplied and removed using flow guide 70.

It will also be recognized that while the principles of the present invention have been described in connection with a print head 50 adapted to supply or remove cleaning fluid 134, cleaning fluid 134 can be applied and/or removed using flow guide 70. An example of an embodiment of this type is shown in FIGS. 11*a* and 11*b*. As is shown in FIG. 11*a*, in this embodiment, flow guide 70 further comprises a cleaning fluid passageway 64 terminating in a cleaning fluid orifice 65 as well as a drain passageway 66 terminating at a drain orifice 67. Both the cleaning orifice 65 and drain orifice 67 are defined in surface 47 of flow guide 70. A pressurized source of cleaning fluid 110 is provided in cleaning member 41. During cleaning operations, pressurized source of cleaning fluid 110 discharges cleaning fluid through cleaning fluid orifice 65 and into flow path 48. This flow 128 of cleaning fluid 134 passes outer surface 68 and cleaning orifice 63 and flows into drain orifice 67. In this embodiment, cleaning member 41 further comprises a fluid return 150 fluidically connected to drain passageway 66. Cleaning fluid that enters drain orifice 67 passes through drain fluid passageway 66 and enters fluid return 150. To assist in this process, fluid return 150 may induce a negative pressure at orifice 67.

Figure 12A:
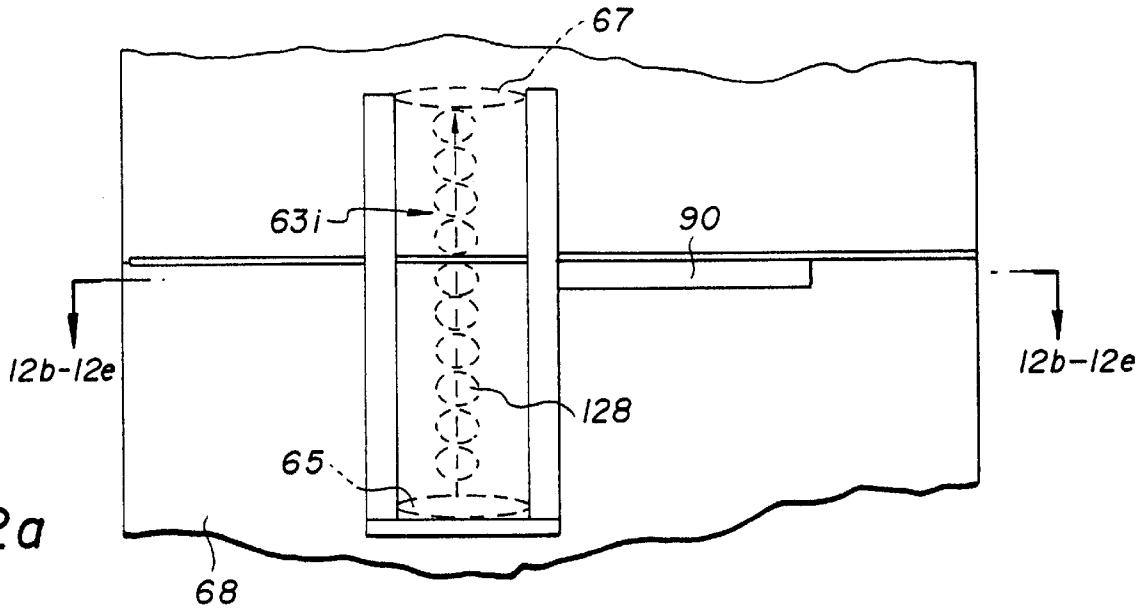
FIG. 12*a* shows a print head of the present invention with movable flow guides in a first position.
Figure 12B:
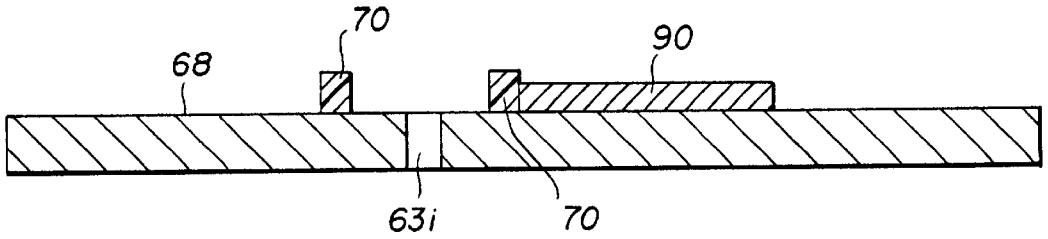
FIG. 12*b* shows a print head of the present invention with movable flow guides in a second position.
Figure 12C:
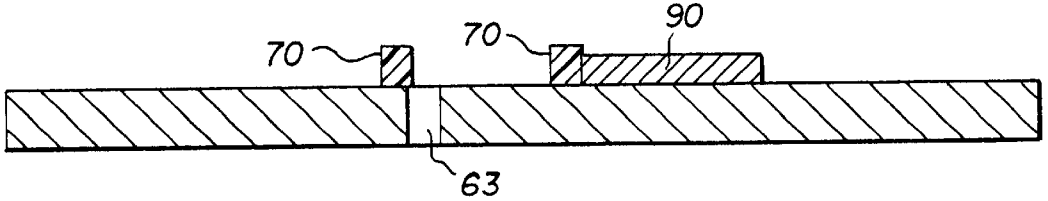
FIG. 12*c* shows a print head of the present invention with movable flow guides in a first position.
Figure 12D:
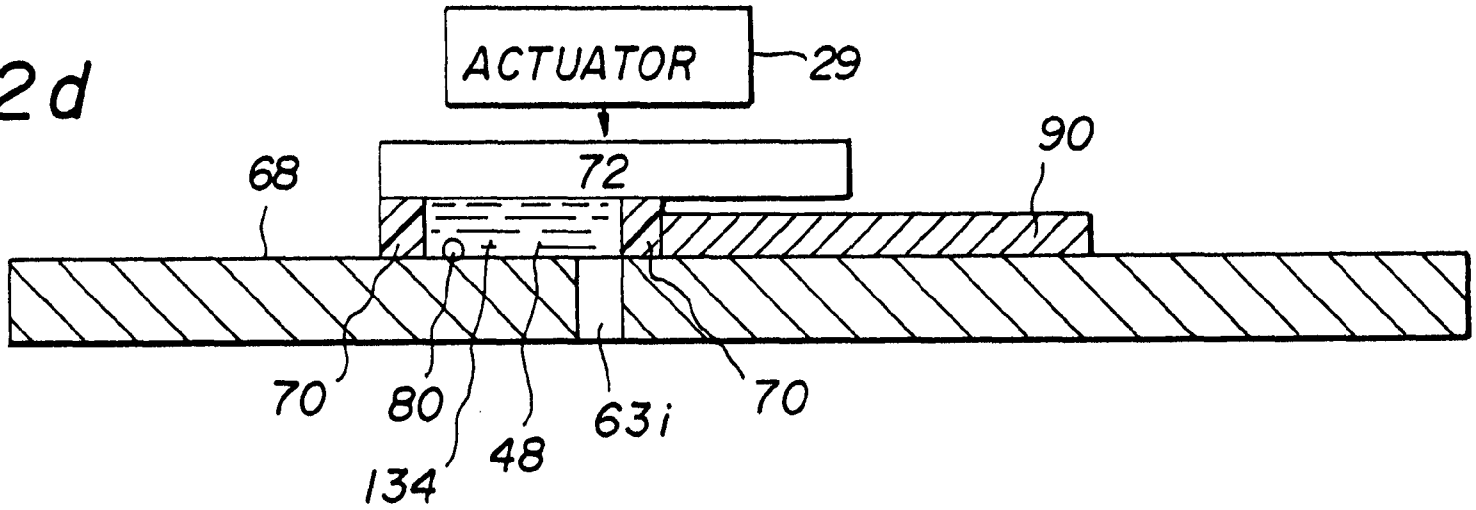
FIG. 12*d* shows a print head of the present invention with movable flow guides in a first cleaning position.
Figure 12E:
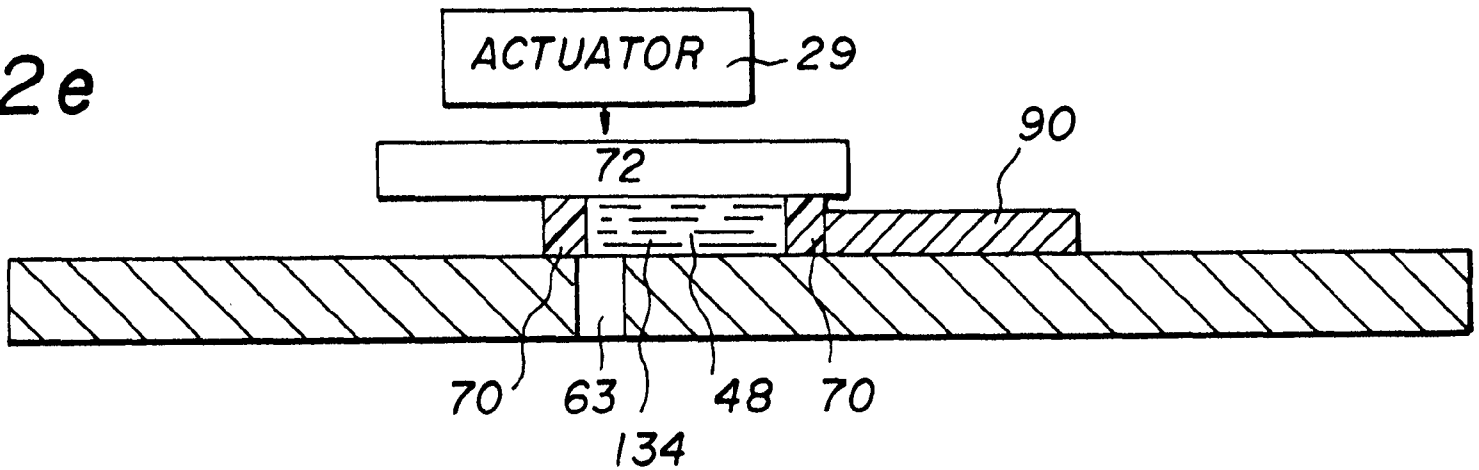
FIG. 12*e* shows a print head of the present invention with movable flow guides in a second cleaning position.

It will also be appreciated, that movable flow guides can be integrated into surface 68 of print head 50. An embodiment of this type is shown in FIGS. 12*a*, 12*b*, and 12*c*. As is shown in FIG. 12*a*, translation drive 90 positions flow guides 70 along outer surface 68 between a first position shown in FIG. 12*b* and a second position shown in FIG. 12*c*. As is shown in FIGS. 12*a*, 12*b*, 12*c*, 12*d*, and 12*e*, during cleaning operations, actuator 29 positions flow guide cap 72 so that cleaning surface 47 is in contact with flow guide 70. This forms a contact seal and provides a flow path 48. Cleaning fluid is discharged into flow path 48 and cleans jet orifices 63*i* and outer surface 68. During cleaning, translation drive 90 moves flow guides 70 between the position shown in 12*d* and the position shown in 12*e* to create cross-currents and vortex flow 92 in the flow 128 of cleaning fluid 134 and to apply mechanical force directly to contaminant 80 or move contaminant 80 from surface 68 and orifices 63*i*. In an alternative embodiment actuator 28 can position flow guide cap 72 so that cleaning surface 47 is proximate to and separate from movable flow guide 70 such as by distance S as described above.

The invention has been described in detail with particular reference to certain preferred embodiments thereof, but it will be understood that variations and modifications can be effected within the spirit and scope of the invention.

PARTS LIST

| | |
|---|---|
| 20 | self-cleaning printer |
| 21 | cabinet |
| 22 | print head advance |
| 24 | controller |
| 26 | media advance |
| 27 | motor |
| 28 | pinch rollers |
| 29 | actuator |
| 30 | printing area |
| 32 | images |
| 34 | media |
| 40 | cleaning area |
| 41 | cleaning member |
| 44 | perimeter |
| 45 | edge |
| 46 | ultrasonic transducer |
| 47 | bottom surface |
| 48 | flow path |
| 49 | sidewalls |
| 50 | print head |
| 51 | top surface |
| 52 | print head body |
| 54 | interior chamber |
| 56 | opening |
| 58 | ink droplets |
| 60 | orifice plate |
| 61 | fluid containment surface |
| 62 | ink jet passageway |
| 63 | ink jet orifice |
| 64 | cleaning fluid passageway |
| 65 | cleaning orifice |
| 66 | drain passageway |
| 67 | drain orifice |
| 68 | outer surface |
| 70 | flow guide |
| 80 | contaminant |
| 90 | translation drive |
| 92 | vortex flow |
| 96 | curtain |
| 98 | bottom edge |
| 99 | wiper |
| 100 | fluid flow system |
| 110 | supply of pressurized ink |
| 126 | meniscus |
| 128 | pressurized flow of cleaning fluid |
| 129 | cleaning fluid bridge |
| 130 | supply of pressurized cleaning fluid |
| 132 | cleaning fluid reservoir |
| 134 | cleaning fluid |
| 150 | fluid return |
| 152 | drain reservoir |
| 156 | drain fluid flow path |
| 158 | drain pump |
| S | space |

What is claimed is:

1. A self-cleaning print head, comprising:

a print head body having an outer surface defining an ink jet orifice;

a source of pressurized cleaning fluid to generate a flow of cleaning fluid at the outer surface during cleaning;

a fluid drain to receive the flow of cleaning fluid;

a movable flow guide defining a flow path from the source of pressurized cleaning fluid along the outer surface and ink jet orifice and to the fluid drain; and a translation drive for moving the flow guide along a path that diverges from the flow path.

2. The self-cleaning print head of claim 1, wherein said flow guide comprises a cleaning surface that defines a capillary flow path and an air to liquid interface formed during cleaning by surface tension between the cleaning surface, outer surface and cleaning fluid.

3. The self-cleaning print head of claim 2, wherein the translation drive moves the cleaning surface in a reciprocal manner.

4. The self-cleaning print head of claim 1, wherein the flow guide comprises a top surface and a curtain having a first end fixed to the top surface and a second end proximate to and separated from the outer surface and wherein a flow of cleaning fluid in the flow path forms a capillary seal between the flow guide and the outer surface.

5. The self-cleaning print head of claim 4, wherein the curtain is formed from a common substrate with the top surface.

6. The self-cleaning print head of claim 4, wherein the curtain is formed from any of a polyisoprene, poly-urethane, poly(ester-urethane), polydimthylsoxane, polyamide, polyvinylchloride, natural rubber, polyethylene, polybutadiene, polyacrylonitrile, and polytetrafluoroethylene.

7. The self-cleaning print head of claim 4, wherein the flow guide has at least one hydrophilic surface confronting the flow of cleaning fluid.

8. The self-cleaning print head of claim 4, wherein the second end of the curtain is positioned at a distance between 10 and 300 microns from the outer surface during cleaning.

9. The self-cleaning print head of claim 1, wherein the flow guide comprises a top surface and a pair of wipers each having a first end fixed to the top surface and a second blade end wherein the wipers are positioned with the blade end in contact with the outer surface during cleaning.

10. The self-cleaning print head of claim 9, wherein the wiper blades apply mechanical force to clean the outer surface and the orifice.

11. The self-cleaning print head of claim 1, wherein the flow guide comprises a movable flow guide barrier on the outer surface and a top surface disposed proximate to and separated from the outer surface during cleaning.

12. The self-cleaning print head of claim 1, wherein the flow guide is movably positioned on the outer surface and a cleaning surface is disposed proximate to and separated from the movable flow guide.

13. The self-cleaning print head of claim 12, wherein the movable flow guide further comprises a cleaning surface disposed in contact with the movable flow guide.

14. The self-cleaning print head of claim 1, further comprising a wiper disposed within the flow guide.

15. The self-cleaning print head of claim 1, wherein the translation drive ultrasonically excites the flow guide and the cleaning fluid.

16. The self-cleaning print head of claim 1 further comprising an ultrasonic transducer to ultrasonically excite the cleaning fluid.

17. A self-cleaning print head, comprising:

a print head body having an outer surface defining an ink jet orifice flanked by a cleaning fluid orifice and a drain orifice;

a movable flow guide defining a flow path for cleaning fluid in a first direction from the cleaning fluid orifice, along the outer surface and ink jet orifice and to the drain orifice;

a source of pressurized cleaning fluid to generate a flow of cleaning fluid from the cleaning orifice during cleaning;

a fluid drain connected to the drain orifice to receive the flow of cleaning fluid; and a translation drive for moving the flow guide in a direction that diverges from the first direction during cleaning.

18. The self-cleaning print head of claim 17, wherein said flow guides comprise a cleaning surface defining a capillary flow path and an air to liquid interface formed during cleaning by surface tension between the cleaning surface, outer surface and cleaning fluid.

19. The self-cleaning print head of claim 17, wherein the flow guide comprises a top surface and a curtain having a first end fixed to the top surface and a second end proximate to arid separated from the outer surface and wherein a flow of cleaning fluid in the flow path forms a capillary seal between the flow guides and the outer surface.

20. The self-cleaning print head of claim 17, wherein the flow guide comprises a top surface and a pair of wipers each having a first end fixed to the cleaning surface and a second blade end wherein the wipers are separated by a space defining the flow guide.

21. The self-cleaning print head of claim 20, wherein said second blade ends mechanically clean the outer surface of the print head during operation.

22. The self-cleaning print head of claim 17, further comprising a wiper disposed within the flow guide.

23. The self-cleaning print head of claim 17 further comprising an ultrasonic transducer to excite the flow of cleaning fluid.

24. A self-cleaning printer, comprising:

a printer body and a print head having an outer surface defining an ink jet orifice;

a source of pressurized cleaning fluid to generate a flow of cleaning fluid at the outer surface during cleaning;

a fluid drain to receive the flow of cleaning fluid;

a movable flow guide defining a flow path from the source of pressurized cleaning fluid along the outer surface and ink jet orifice and to the fluid drain; and a translation drive for moving the flow guide along a path that diverges from the flow path.

25. The self-cleaning printer of claim 24, wherein said flow guide comprises a cleaning surface that defines a capillary flow path and an air to liquid interface formed during cleaning by surface tension between the cleaning surface, outer surface and cleaning fluid.

26. The self-cleaning printer of claim 25, wherein the translation drive moves the cleaning surface in a reciprocal manner.

27. The self-cleaning printer of claim 24, wherein the flow guide comprises a top surface and a curtain having a first end fixed to the top surface and a second end proximate to and separated from the outer surface and wherein a flow of cleaning fluid in the flow path forms a capillary seal between the flow guide and the outer surface.

28. The self-cleaning printer of claim 27, wherein the curtain is formed from a common substrate with the top surface.

29. The self-cleaning printer of claim 27, wherein the curtain is formed from any of a polyisoprene, poly-urethane, poly(ester-urethane), polydimthylsoxane, polyamide, polyvinylchloride, natural rubber, polyethylene, polybutadiene, polyacrylonitrile, and polytetrafluoroethylene.

30. The self-cleaning printer of claim 27, wherein the second end of the curtain is positioned at a distance between 10 and 300 microns from the outer surface during cleaning.

31. The self-cleaning printer of claim 24, wherein the flow guide has at least one hydrophilic surface confronting the flow of cleaning fluid.

32. The self-cleaning printer of claim 24, wherein the flow guide comprises a top surface and a pair of wipers each having a first end fixed to the top surface and a second blade end wherein the wipers are positioned in contact with the outer surface during cleaning.

33. The self-cleaning printer of claim 32, further comprising a wiper disposed between the flow guide.

34. The self-cleaning printer of claim 24, wherein the flow guide comprises a movable flow guide on the outer surface and a top surface disposed proximate to and separated from the outer surface during cleaning.

35. The self-cleaning printer of claim 24 wherein the flow guide is movably positioned on the outer surface and a cleaning surface disposed proximate to and separated from the movable flow guide.

36. The self-cleaning printer of claim 24, wherein the flow guide further comprises a cleaning surface disposed in contact with the movable flow guide.

37. The self-cleaning print head of claim 24, wherein the translation drive ultrasonically excites the flow guide and the cleaning fluid.

38. The self-cleaning print head of claim 24 further comprising an ultrasonic transducer.

39. A self-cleaning printer, comprising:

a printer body and a print head having an outer surface defining an ink jet orifice flanked by a cleaning fluid orifice and a drain orifice;

a movable flow guide defining a flow path for cleaning fluid in a first direction from the cleaning fluid orifice, along the outer surface and ink jet orifice and to the drain orifice;

a source of pressurized cleaning fluid to generate a flow of cleaning fluid from the cleaning orifice during cleaning;

a fluid drain connected to the drain orifice to receive the flow of cleaning fluid; and a translation drive for moving the flow guide along a path that diverges from the direction of flow of the cleaning fluid flow path during cleaning.

40. The self-cleaning printer of claim 39, wherein said flow guide comprises a cleaning surface that defines a capillary flow path, and an air to liquid interface formed during cleaning by surface tension between the cleaning surface, outer surface and cleaning fluid.

41. The self-cleaning printer of claim 39, wherein the flow guide comprises a top surface and a sheet having a first end fixed to the top surface and a second end proximate to and separated from the outer surface and wherein a flow of cleaning fluid in the flow path forms a capillary seal between the flow guides and the outer surface.

42. The self-cleaning printer of claim 40, wherein said flow guide comprises a cleaning surface that defines a capillary flow path and an air to liquid interface formed during cleaning by surface tension between the cleaning surface, outer surface and cleaning fluid.

43. The self-cleaning printer of claim 39, wherein the flow guide comprises a top surface and a pair of wipers each having a first end fixed to the cleaning surface and a second blade end wherein the wipers are separated by a space defining the flow guide.

44. The self-cleaning printer of claim 43, wherein said second blade end mechanically cleans the outer surface of the print head during operation.

45. The self-cleaning printer of claim 39, further comprising a wiper disposed between the flow guides.

46. The self-cleaning printer of claim 39 further comprising an ultrasonic transducer to excite the flow of cleaning fluid.

47. A method for cleaning a print head body having an outer surface which defines an ink jet orifice, a pressurized source of cleaning fluid and a cleaning fluid drain; the method comprising:

providing a movable flow guide member which defines a flow path for cleaning fluid in a first direction from the source, along the outer surface, and to the drain;

generating a flow of cleaning fluid through the movable flow guide member along the flow path; and moving the flow guide in a direction that diverges from the first direction.

48. The method of claim 47 further comprises the step of ultrasonically exciting the flow of cleaning fluid.

49. A method for cleaning a print head body having an outer surface which defines an ink jet orifice, a pressurized source of cleaning fluid, a wiper, an a cleaning fluid drain; the method comprising:

providing a movable flow guide member which defines a flow path for cleaning fluid in a first direction from the source, along the outer surface, and to the drain;

generating a flow of cleaning fluid through the movable flow guide member along the flow path; and moving the flow guide and wiper in a direction that diverges from the first direction.

50. The method of claim 49 further comprising the step of ultrasonically exciting the flow of cleaning fluid.

* * * * *

UNITED STATES PATENT AND TRADEMARK OFFICE

CERTIFICATE OF CORRECTION

PATENT NO. : 6,572,215 B2
DATED : June 3, 2003
INVENTOR(S) : Ravi Sharma

It is certified that error appears in the above-identified patent and that said Letters Patent is hereby corrected as shown below:

Column 16,
Line 9, delete "arid" and insert -- and --

Signed and Sealed this

Twenty-third Day of December, 2003

JAMES E. ROGAN
*Director of the United States Patent and Trademark Office*